US011037441B2

(12) United States Patent
Jiang et al.

(10) Patent No.: US 11,037,441 B2
(45) Date of Patent: Jun. 15, 2021

(54) SYSTEMS AND METHODS FOR TRAFFIC LIGHT TIMING

(71) Applicant: BEIJING DIDI INFINITY TECHNOLOGY AND DEVELOPMENT CO., LTD., Beijing (CN)

(72) Inventors: Shuai Jiang, Beijing (CN); Jinqing Zhu, Beijing (CN)

(73) Assignee: BEIJING DIDI INFINITY TECHNOLOGY AND DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/785,838

(22) Filed: Feb. 10, 2020

(65) Prior Publication Data

US 2020/0175860 A1 Jun. 4, 2020

Related U.S. Application Data

(63) Continuation of application No. PCT/CN2017/096386, filed on Aug. 8, 2017.

(51) Int. Cl.
*G08G 1/083* (2006.01)
*G08G 1/01* (2006.01)

(52) U.S. Cl.
CPC ..... *G08G 1/083* (2013.01); *G08G 1/0112* (2013.01); *G08G 1/0129* (2013.01); *G08G 1/0145* (2013.01)

(58) Field of Classification Search
CPC .... G08G 1/083; G08G 1/0112; G08G 1/0129; G08G 1/0145; G08G 1/202; G08G 1/0133; G08G 1/08
(Continued)

(56) References Cited

U.S. PATENT DOCUMENTS 9,633,560 B1 4/2017 Gao et al.
10,002,530 B1 6/2018 Liu et al.
(Continued)

FOREIGN PATENT DOCUMENTS

CA 2844536 A1 2/2013
CN 101789151 A 7/2010
(Continued)

OTHER PUBLICATIONS

International Search Report in PCT/CN2017/096377 dated Apr. 27, 2018, 4 Pages.
(Continued)

*Primary Examiner* — Adnan Aziz
(74) *Attorney, Agent, or Firm* — Metis IP LLC

(57) ABSTRACT

The present disclosure relates to systems and methods for generating a control parameter associated with a plurality of traffic lights for a plurality of traffic-regulated sections at an intersection. The system may perform the methods to obtain a plurality of traffic parameters for the plurality of traffic-regulated sections; determine a traffic status of the intersection based on the plurality of traffic parameters; determine a target condition based on the traffic status of the intersection; and generate a control parameter associated with the plurality of traffic lights by using a target function, wherein the control parameter is configured to alter the operation of the plurality of traffic lights to optimize traffic at the intersection to reach the target condition.

20 Claims, 14 Drawing Sheets

(58) Field of Classification Search
USPC ..... 340/902, 904, 905, 906, 907, 917, 13.3
See application file for complete search history.

(56) References Cited

U.S. PATENT DOCUMENTS

| | | | | |
|---|---|---|---|---|
| 10,078,962 | B1 * | 9/2018 | Epperlein | G08G 1/08 |
| 2002/0082767 | A1 * | 6/2002 | Mintz | G08G 1/0133 701/117 |
| 2008/0204277 | A1 | 8/2008 | Sumner | |
| 2009/0322561 | A1 * | 12/2009 | Morioka | G08G 1/08 340/907 |
| 2011/0037619 | A1 | 2/2011 | Ginsberg et al. | |
| 2013/0048795 | A1 | 2/2013 | Cross | |
| 2013/0342370 | A1 | 12/2013 | Sharma et al. | |
| 2015/0312529 | A1 | 10/2015 | Bernal et al. | |
| 2016/0267790 | A1 | 9/2016 | Raamot | |
| 2017/0154525 | A1 | 6/2017 | Zou et al. | |
| 2017/0206783 | A1 | 7/2017 | Miller | |
| 2017/0270785 | A1 * | 9/2017 | Umehara | G08G 1/0112 |
| 2018/0151064 | A1 | 5/2018 | Xu et al. | |

FOREIGN PATENT DOCUMENTS

| | | | |
|---|---|---|---|
| CN | 102142197 | A | 8/2011 |
| CN | 102254439 | B | 3/2013 |
| CN | 103208191 | A | 7/2013 |
| CN | 104011779 | A | 8/2014 |
| CN | 104077920 | A | 10/2014 |
| CN | 104464311 | A | 3/2015 |
| CN | 105023428 | A | 11/2015 |
| CN | 105551271 | A | 5/2016 |
| CN | 105679051 | A | 6/2016 |
| CN | 105957371 | A | 9/2016 |
| CN | 106415676 | A | 2/2017 |
| CN | 106910349 | A | 6/2017 |
| CN | 106971563 | A | 7/2017 |
| EP | 2187369 | A2 | 5/2010 |
| JP | H1026534 | A | 1/1998 |
| JP | 2008033774 | A | 2/2008 |
| TW | 201142765 | A | 12/2011 |
| TW | 201142766 | A | 12/2011 |
| TW | 201423679 | A | 6/2014 |
| WO | 2016018936 | A1 | 2/2016 |
| WO | 2017128890 | A1 | 8/2017 |

OTHER PUBLICATIONS

Written Opinion in PCT/CN2017/096377 dated Apr. 27, 2018, 4 Pages.

International Search Report in PCT/CN2017/096386 dated Apr. 17, 2018, 4 Pages.

Written Opinion in PCT/CN2017/098386 dated Apr. 17, 2018, 4 Pages.

Zhang, Wei et al., Traffic Congestion Evaluation and Signal Control Optimization Based on Wireless Sensor Networks: Model and Algorithms, 18 Pages, 2012.

Tian, Yongping, A Study on Timing Transition Periods at Signalized Intersections Using Simulation Approach. National Chiao Tung University, 2006, 82 Pages.

Ahmad Fawad et al., Shortest Processing Time Scheduling to Reduce Traffic Congestion in Dense Urban Areas, IEEEE Transactions on Systems, Man, and Cybernetics: Systems, 47(5): 838-855, 2017.

Extended European Search Report in European Application No. 17920657.8 dated Jul. 10, 2020, 8 pages.

Extended European Search Report in European Application No. 17920901.0 dated Jun. 25, 2020, 9 pages.

First Office Action in Chinese application No. 201780041274.7 dated Jan. 28, 2021, 34 pages.

* cited by examiner

Traffic Flow:
AB, BA, CD, DC
AC, CB, BD, DA
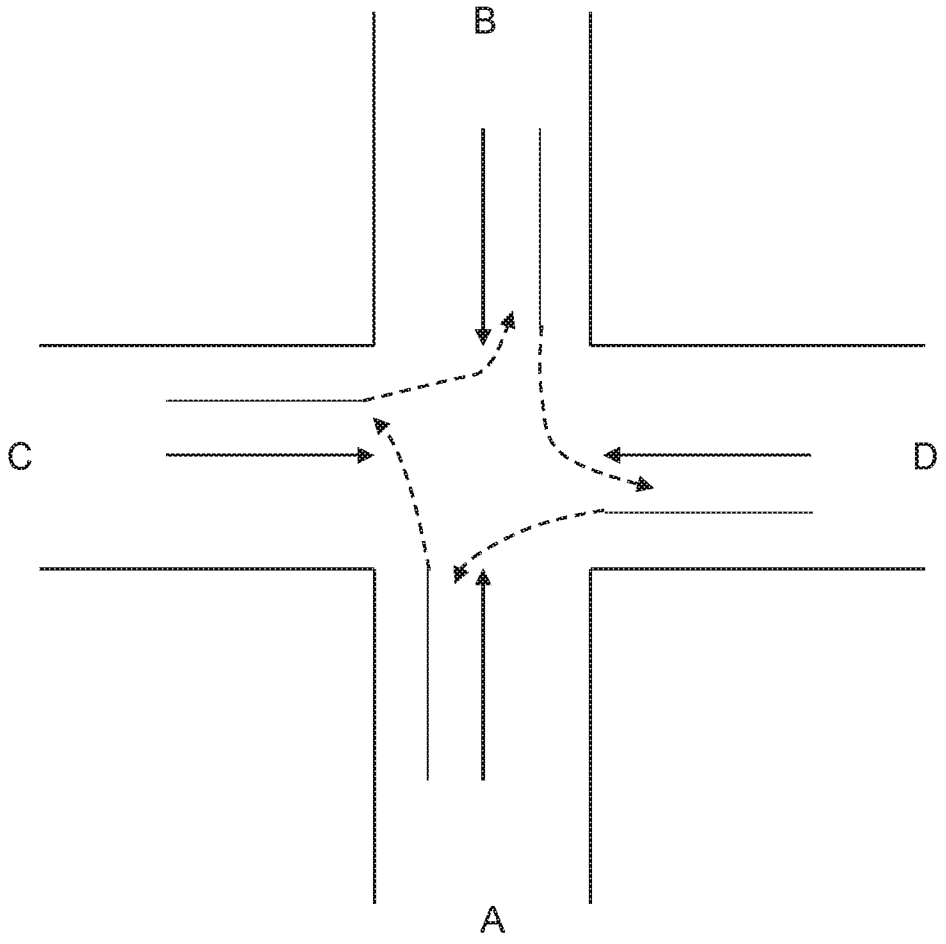
FIG. 13-A

Traffic Flow:
AB, BA, CD, DC
AC, CB, BD, DA
AD, DB, BC, CA
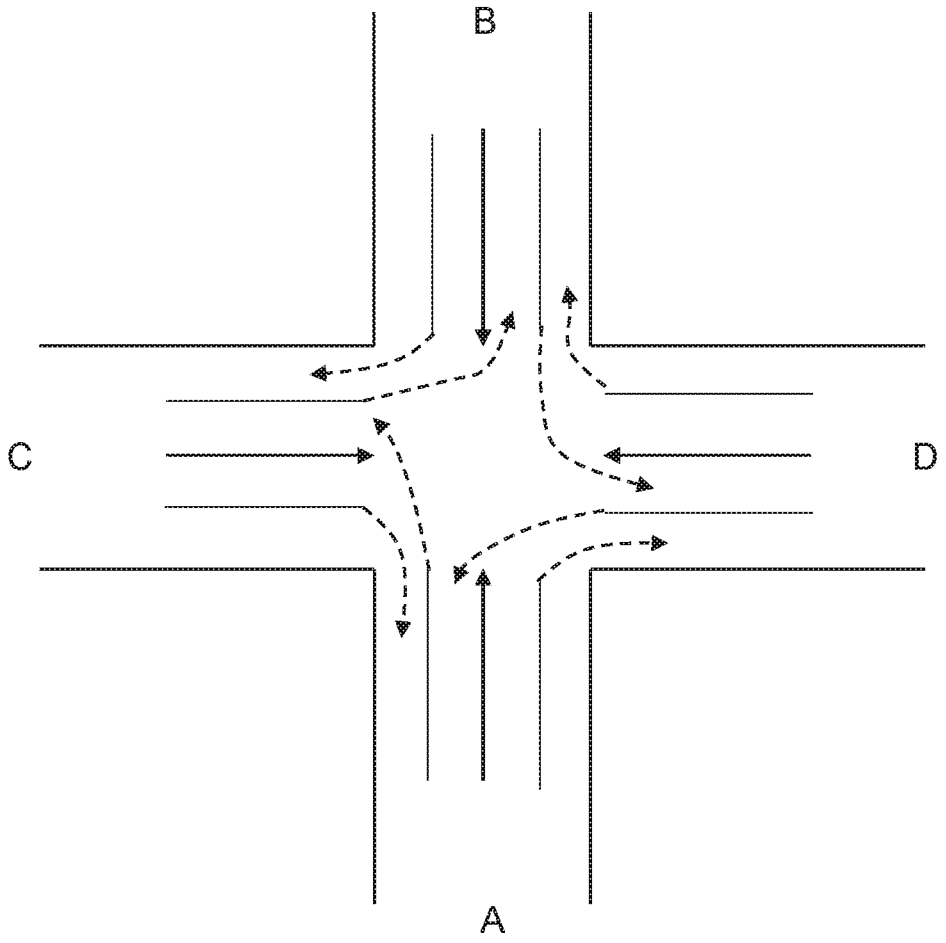
FIG. 13-B

SYSTEMS AND METHODS FOR TRAFFIC LIGHT TIMING

CROSS-REFERENCE TO RELATED APPLICATIONS

This application is a Continuation of International Application No. PCT/CN2017/096386, filed on Aug. 8, 2017, the entire contents of which are hereby incorporated by reference.

TECHNICAL FIELD

The present disclosure generally relates to systems and methods for traffic light timing, and in particular, to systems and methods for traffic lighting timing based on GPS information associated with vehicles.

BACKGROUND

Traffic light timing plays an important role in modern society. A system for controlling traffic light timing may obtain vehicle information (e.g., a time point when a vehicle passes through an intersection) from hardware components installed underground near the intersection. However, in some situations, it may be difficult to detect the vehicle information efficiently by the hardware components and the maintenance cost may be relatively high.

SUMMARY

According to an aspect of the present disclosure, a system is provided. The system may include at least one storage medium and at least one processor in communication with the at least one storage medium. The at least one storage medium may include a set of instructions for generating a control parameter associated with a plurality of traffic lights for a plurality of traffic-regulated sections at an intersection, wherein a traffic light corresponds to a traffic-regulated section. When the at least one processor executes the set of instructions, the at least one processor may be directed to perform one or more of the following operations. The at least one processor may obtain a plurality of traffic parameters for the plurality of traffic-regulated sections, wherein the plurality of traffic parameters may include a queue length of each individual traffic-regulated section in the plurality of traffic-regulated sections, an aggregation rate of the queue, a dissipation rate of the queue, and/or an average passing rate of the queue. The at least one processor may determine a traffic status of the intersection based on the plurality of traffic parameters. The at least one processor may determine a target condition based on the traffic status of the intersection. The at least one processor may generate a control parameter associated with the plurality of traffic lights by using a target function, wherein the control parameter may be configured to alter the operation of the plurality of traffic lights to optimize traffic at the intersection to reach the target condition.

According to another aspect of the present disclosure, a method is provided. The method may be implemented on a computing device having at least one processor, at least one storage medium and a communication platform connected to a network. The method may include one or more of the following operations. The at least one processor may obtain a plurality of traffic parameters for the plurality of traffic-regulated sections, wherein the plurality of traffic parameters may include a queue length of each individual traffic-regulated section in the plurality of traffic-regulated sections, an aggregation rate of the queue, a dissipation rate of the queue, and/or an average passing rate of the queue. The at least one processor may determine a traffic status of the intersection based on the plurality of traffic parameters. The at least one processor may determine a target condition based on the traffic status of the intersection. The at least one processor may generate a control parameter associated with the plurality of traffic lights by using a target function, wherein the control parameter may be configured to alter the operation of the plurality of traffic lights to optimize traffic at the intersection to reach the target condition.

In some embodiments, the at least one processor may determine the target function based on the plurality of traffic parameters.

In some embodiments, the at least one processor may determine a plurality of dissipation times of a plurality of queues in the plurality of traffic-regulated sections, wherein the dissipation time may be determined based on the queue length and the dissipation rate of the queue, and a dissipation time may correspond to a traffic-regulated section.

In some embodiments, the at least one processor may determine whether one of the plurality of dissipation times is more than a first green light time of a first traffic light, wherein the first traffic light corresponds to a first traffic-regulated section which corresponds to the one of the plurality of dissipation times. The at least one processor may determine a first traffic status in response to the determination that one of the plurality of dissipation times is more than the green light time of the traffic light.

In some embodiments, the at least one processor may determine a first target condition based on the first traffic status, wherein the first target condition may be to maximize an average number of vehicles that pass through the intersection.

In some embodiments, the at least one processor may determine whether each of the plurality of queue lengths of the plurality of traffic-regulated sections is less than a threshold length in response to the determination that each of the plurality of dissipation time is less than or equal to a green light time of a corresponding traffic light. The at least one processor may determine a second traffic status in response to the determination that each of the plurality of queue lengths is less than the threshold length.

In some embodiments, the at least one processor may determine a second target condition based on the second traffic status, wherein the second target condition may be to minimize an average delay time of vehicles passing through at the intersection.

In some embodiments, the at least one processor may determine a third traffic status in response to the determination that one of the plurality of queue lengths is longer than or equal to the threshold length.

In some embodiments, the at least one processor may determine a third target condition based on the third traffic status, wherein the third target condition may be to minimize a highest ratio of the queue length to the threshold length among the ratios corresponding to the traffic-regulated sections at the intersection.

In some embodiments, the control parameter may include a cycle time of each traffic light, a ratio of green light time to cycle time of each traffic light, and/or a phase design of the plurality of traffic lights.

In some embodiments, the at least one processor may determine a constraint condition based on the traffic status, wherein the control parameter is determined based on the target function and the constraint condition.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

FIG. 13-A and FIG. 13-B are a schematic diagrams illustrating exemplary traffic flows at an intersection according to some embodiments of the present disclosure.

DETAILED DESCRIPTION

Figure 1:
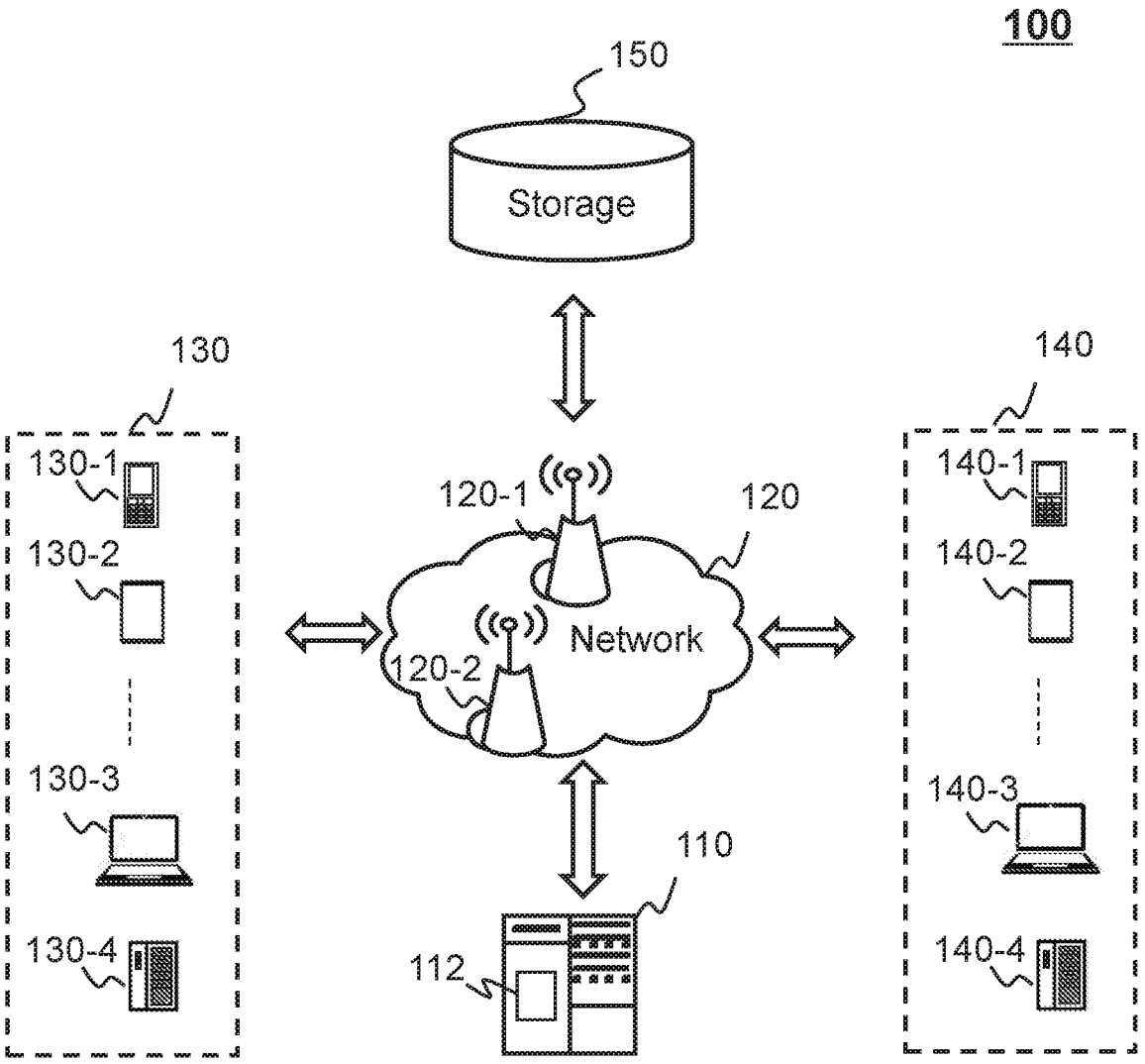
FIG. 1 is a schematic diagram illustrating an exemplary on-demand service system according to some embodiments of the present disclosure.

The following description is presented to enable any person skilled in the art to make and use the present disclosure, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but is to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprises," "comprising," "includes," and/or "including" when used in this disclosure, specify the presence of stated features, integers, steps, operations, elements, and/or components, but do not preclude the presence or addition of one or more other features, integers, steps, operations, elements, components, and/or groups thereof.

These and other features, and characteristics of the present disclosure, as well as the methods of operations and functions of the related elements of structure and the combination of parts and economies of manufacture, may become more apparent upon consideration of the following description with reference to the accompanying drawing(s), all of which form part of this specification. It is to be expressly understood, however, that the drawing(s) are for the purpose of illustration and description only and are not intended to limit the scope of the present disclosure. It is understood that the drawings are not to scale.

The flowcharts used in the present disclosure illustrate operations that systems implement according to some embodiments of the present disclosure. It is to be expressly understood, the operations of the flowcharts may be implemented not in order. Conversely, the operations may be implemented in inverted order, or simultaneously. Moreover, one or more other operations may be added to the flowcharts. One or more operations may be removed from the flowcharts.

Moreover, while the systems and methods disclosed in the present disclosure are described primarily regarding on-demand transportation service, it should also be understood that this is only one exemplary embodiment. The system or method of the present disclosure may be applied to any other kind of on-demand service. For example, the system or method of the present disclosure may be applied to different transportation systems including land, ocean, aerospace, or the like, or any combination thereof. The vehicle of the transportation systems may include a taxi, a private car, a hitch, a bus, a driverless vehicle, or the like, or any combination thereof. The transportation system may also include any transportation system that applies management and/or distribution, for example, a system for transmitting and/or receiving an express. The application scenarios of the system or method of the present disclosure may include a web page, a plug-in of a browser, a client terminal, a custom system, an internal analysis system, an artificial intelligence robot, or the like, or any combination thereof.

The terms "passenger," "requestor," "service requestor," and "customer" in the present disclosure are used interchangeably to refer to an individual, an entity or a tool that may request or order a service. Also, the terms "driver," "provider," "service provider," and "supplier" in the present disclosure are used interchangeably to refer to an individual, an entity, or a tool that may provide a service or facilitate the providing of the service. The term "user" in the present disclosure may refer to an individual, an entity, or a tool that may request a service, order a service, provide a service, or facilitate the providing of the service. For example, the user may be a passenger, a driver, an operator, or the like, or any combination thereof. In the present disclosure, terms "passenger" and "passenger terminal" may be used interchangeably, and terms "driver" and "driver terminal" may be used interchangeably.

The term "service request" in the present disclosure refers to a request that initiated by a passenger, a requestor, a service requestor, a customer, a driver, a provider, a service provider, a supplier, or the like, or any combination thereof. The service request may be accepted by any one of a passenger, a requestor, a service requestor, a customer, a driver, a provider, a service provider, or a supplier. The service request may be chargeable, or free.

The positioning technology used in the present disclosure may include a global positioning system (GPS), a global navigation satellite system (GLONASS), a compass navigation system (COMPASS), a Galileo positioning system, a quasi-zenith satellite system (QZSS), a wireless fidelity (WiFi) positioning technology, or the like, or any combination thereof. One or more of the above positioning technologies may be used interchangeably in the present disclosure.

An aspect of the present disclosure relates to systems and methods for generating traffic control parameters associated with a traffic light based on GPS information of vehicles. For example, the systems and methods may obtain GPS information of a plurality of vehicles from GPS devices integrated in terminals associated with the vehicles. The systems and methods may determine driving track information of the vehicles based on the GPS information. The systems and methods may determine traffic parameters (e.g., a length of a queue, an aggregation rate of the queue, a dissipation rate of the queue, an average passing rate of the queue) of an intersection based on the driving track information. Further, the systems and methods may further generate traffic control parameters (e.g., a cycle time, a ratio of green light time to cycle time) for the intersection based on the traffic parameters.

It should be noted that GPS positioning, overall, is a technology deeply rooted in Internet world. Generating traffic control parameters associated with a traffic light based on GPS information of vehicles is not possible without the communication between a terminal associated with a vehicle and a remote server. Therefore, the technical solution disclosed in the present disclosure is also a technology deeply rooted in Internet era.

FIG. 1 is a schematic diagram of an exemplary on-demand service system 100 according to some embodiments of the present disclosure. For example, the on-demand service system 100 may be an online transportation service platform for transportation services such as taxi hailing, chauffeur services, delivery vehicles, carpool, bus service, driver hiring, and shuttle services. The on-demand service system 100 may be an online platform including a server 110, a network 120, a requestor terminal 130, a provider terminal 140, and a storage 150. The server 110 may include a processing engine 112.

In some embodiments, the server 110 may be a single server, or a server group. The server group may be centralized, or distributed (e.g., server 110 may be a distributed system). In some embodiments, the server 110 may be local or remote. For example, the server 110 may access information and/or data stored in the requestor terminal 130, the provider terminal 140, and/or the storage 150 via the network 120. As another example, the server 110 may connect the requestor terminal 130, the provider terminal 140, and/or the storage 150 to access stored information and/or data. In some embodiments, the server 110 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof. In some embodiments, the server 110 may be implemented on a computing device 200 having one or more components illustrated in FIG. 2 in the present disclosure.

In some embodiments, the server 110 may include a processing engine 112. The processing engine 112 may process information and/or data relating to the service request to perform one or more functions described in the present disclosure. For example, the processing engine 112 may obtain GPS information associated with a plurality of vehicles from a plurality of provider terminals 140 and generate traffic control parameters based on the GPS information. In some embodiments, the processing engine 112 may include one or more processing engines (e.g., single-core processing engine(s) or multi-core processor(s)). Merely by way of example, the processing engine 112 may include one or more hardware processors, such as a central processing unit (CPU), an application-specific integrated circuit (ASIC), an application-specific instruction-set processor (ASIP), a graphics processing unit (GPU), a physics processing unit (PPU), a digital signal processor (DSP), a field programmable gate array (FPGA), a programmable logic device (PLD), a controller, a microcontroller unit, a reduced instruction-set computer (RISC), a microprocessor, or the like, or any combination thereof.

The network 120 may facilitate exchange of information and/or data. In some embodiments, one or more components of the on-demand service system 100 (e.g., the server 110, the requestor terminal 130, the provider terminal 140, and the storage 150) may transmit information and/or data to other component(s) in the on-demand service system 100 via the network 120. For example, the server 110 may receive a service request from the requestor terminal 130 via the network 120. In some embodiments, the network 120 may be any type of wired or wireless network, or combination thereof. Merely by way of example, the network 120 may include a cable network, a wireline network, an optical fiber network, a tele communications network, an intranet, an Internet, a local area network (LAN), a wide area network (WAN), a wireless local area network (WLAN), a metropolitan area network (MAN), a public telephone switched network (PSTN), a Bluetooth network, a ZigBee network, a near field communication (NFC) network, or the like, or any combination thereof. In some embodiments, the network 120 may include one or more network access points. For example, the network 120 may include wired or wireless network access points such as base stations and/or internet exchange points 120-1, 120-2, . . . , through which one or more components of the on-demand service system 100 may be connected to the network 120 to exchange data and/or information between them.

In some embodiments, a requestor may be a user of the requestor terminal 130. In some embodiments, the user of the requestor terminal 130 may be someone other than the requestor. For example, a user A of the requestor terminal 130 may use the requestor terminal 130 to transmit a service request for a user B, or receive service and/or information or instructions from the server 110. In some embodiments, a provider may be a user of the provider terminal 140. In some embodiments, the user of the provider terminal 140 may be someone other than the provider. For example, a user C of the provider terminal 140 may use the provider terminal 140 to receive a service request for a user D, and/or information or instructions from the server 110. In some embodiments, "requestor" and "requestor terminal" may be used interchangeably, and "provider" and "provider terminal" may be used interchangeably.

In some embodiments, the requestor terminal 130 may include a mobile device 130-1, a tablet computer 130-2, a laptop computer 130-3, a built-in device in a motor vehicle 130-4, or the like, or any combination thereof. In some embodiments, the mobile device 130-1 may include a smart home device, a wearable device, a smart mobile device, a virtual reality device, an augmented reality device, or the like, or any combination thereof. In some embodiments, the smart home device may include a smart lighting device, a control device of an intelligent electrical apparatus, a smart monitoring device, a smart television, a smart video camera, an interphone, or the like, or any combination thereof. In some embodiments, the wearable device may include a smart bracelet, a smart footgear, a smart glass, a smart helmet, a smart watch, a smart clothing, a smart backpack, a smart accessory, or the like, or any combination thereof. In some embodiments, the smart mobile device may include a smartphone, a personal digital assistance (PDA), a gaming device, a navigation device, a point of sale (POS) device, or the like, or any combination thereof. In some embodiments, the virtual reality device and/or the augmented reality device may include a virtual reality helmet, a virtual reality glass, a virtual reality patch, an augmented reality helmet, an augmented reality glass, an augmented reality patch, or the like, or any combination thereof. For example, the virtual reality device and/or the augmented reality device may include a Google Glass™, a RiftCon™, a Fragments™, a Gear VR™, etc. In some embodiments, the built-in device in the motor vehicle 130-4 may include an onboard computer, an onboard television, etc. In some embodiments, the requestor terminal 130 may be a device with positioning technology for locating the position of the requestor and/or the requestor terminal 130.

In some embodiments, the provider terminal 140 may be similar to, or the same device as the requestor terminal 130. In some embodiments, the provider terminal 140 may be a device with positioning technology for locating the position of the provider and/or the provider terminal 140. In some embodiments, the provider terminal 140 may periodically transmit GPS information to the server 110. In some embodiments, the requestor terminal 130 and/or the provider terminal 140 may communicate with another positioning device to determine the position of the requestor, the requestor terminal 130, the provider, and/or the provider terminal 140. In some embodiments, the requestor terminal 130 and/or the provider terminal 140 may transmit positioning information to the server 110.

The storage 150 may store data and/or instructions. In some embodiments, the storage 150 may store data obtained from the requestor terminal 130 and/or the provider terminal 140. In some embodiments, the storage 150 may store data and/or instructions that the server 110 may execute or use to perform exemplary methods described in the present disclosure. In some embodiments, the storage 150 may include a mass storage, a removable storage, a volatile read-and-write memory, a read-only memory (ROM), or the like, or any combination thereof. Exemplary mass storage may include a magnetic disk, an optical disk, a solid-state drive, etc. Exemplary removable storage may include a flash drive, a floppy disk, an optical disk, a memory card, a zip disk, a magnetic tape, etc. Exemplary volatile read-and-write memory may include a random access memory (RAM). Exemplary RAM may include a dynamic RAM (DRAM), a double date rate synchronous dynamic RAM (DDR SDRAM), a static RAM (SRAM), a thyristor RAM (T-RAM), and a zero-capacitor RAM (Z-RAM), etc. Exemplary ROM may include a mask ROM (MROM), a programmable ROM (PROM), an erasable programmable ROM (EPROM), an electrically erasable programmable ROM (EEPROM), a compact disk ROM (CD-ROM), and a digital versatile disk ROM, etc. In some embodiments, the storage 150 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof.

In some embodiments, the storage 150 may be connected to the network 120 to communicate with one or more components of the on-demand service system 100 (e.g., the server 110, the requestor terminal 130, the provider terminal 140). One or more components in the on-demand service system 100 may access the data or instructions stored in the storage 150 via the network 120. In some embodiments, the storage 150 may be directly connected to or communicate with one or more components in the on-demand service system 100 (e.g., the server 110, the requestor terminal 130, the provider terminal 140). In some embodiments, the storage 150 may be part of the server 110.

In some embodiments, one or more components of the on-demand service system 100 (e.g., the server 110, the requestor terminal 130, the provider terminal 140) may access the storage 150. In some embodiments, one or more components of the on-demand service system 100 may read and/or modify information relating to the requester, provider, and/or the public when one or more conditions are met. For example, the server 110 may read and/or modify one or more users' information after a service. As another example, the provider terminal 140 may access information relating to the requestor when receiving a service request from the requestor terminal 130, but the provider terminal 140 may not modify the relevant information of the requestor.

In some embodiments, information exchanging of one or more components of the on-demand service system 100 may be achieved by way of requesting a service. The object of the service request may be any product. In some embodiments, the product may be a tangible product, or immaterial product. The tangible product may include food, medicine, commodity, chemical product, electrical appliance, clothing, car, housing, luxury, or the like, or any combination thereof. The immaterial product may include a servicing product, a financial product, a knowledge product, an internet product, or the like, or any combination thereof. The internet product may include an individual host product, a web product, a mobile internet product, a commercial host product, an embedded product, or the like, or any combination thereof. The mobile internet product may be used in a software of a mobile terminal, a program, a system, or the like, or any combination thereof. The mobile terminal may include a tablet computer, a laptop computer, a mobile phone, a personal digital assistance (PDA), a smart watch, a point of sale (POS) device, an onboard computer, an onboard television, a wearable device, or the like, or any combination thereof. For example, the product may be any software and/or application used on the computer or mobile phone. The software and/or application may relate to socializing, shopping, transporting, entertainment, learning, investment, or the like, or any combination thereof. In some embodiments, the software and/or application relating to transporting may include a traveling software and/or application, a vehicle scheduling software and/or application, a mapping software and/or application, etc. In the vehicle scheduling software and/or application, the vehicle may include a horse, a carriage, a rickshaw (e.g., a wheelbarrow, a bike, a tricycle), a car (e.g., a taxi, a bus, a private car), or the like, or any combination thereof.

One of ordinary skill in the art would understand that when an element of the on-demand service system 100 performs, the element may perform through electrical signals and/or electromagnetic signals. For example, when a requestor terminal 130 processes a task, such as making a determination, identifying or selecting an object, the requestor terminal 130 may operate logic circuits in its processor to process such task. When the requestor terminal 130 sends out a service request to the server 110, a processor of the service requestor terminal 130 may generate electrical signals encoding the service request. The processor of the requestor terminal 130 may then send the electrical signals to an output port. If the requestor terminal 130 communicates with the server 110 via a wired network, the output port may be physically connected to a cable, which may further transmit the electrical signals to an input port of the server 110. If the requestor terminal 130 communicates with the server 110 via a wireless network, the output port of the requestor terminal 130 may be one or more antennas, which may convert the electrical signals to electromagnetic signals. Similarly, a provider terminal 140 may process a task through operation of logic circuits in its processor, and receive an instruction and/or service request from the server 110 via electrical signals or electromagnet signals. Within an electronic device, such as the requestor terminal 130, the provider terminal 140, and/or the server 110, when a processor thereof processes an instruction, sends out an instruction, and/or performs an action, the instruction and/or action is conducted via electrical signals. For example, when the processor retrieves or saves data from a storage medium (e.g., the storage 150), it may send out electrical signals to a read/write device of the storage medium, which may read or write structured data in the storage medium. The structured data may be transmitted to the processor in the form of electrical signals via a bus of the electronic device. Here, an electrical signal may refer to one electrical signal, a series of electrical signals, and/or a plurality of discrete electrical signals.

It should be noted that the application scenario illustrated in FIG. 1 is only provided for illustration purposes, and not intended to limit the scope of the present disclosure. For example, the on-demand service system 100 may be used as a navigation system. The navigation system may include a user terminal (e.g., the provider terminal 140) and a server (e.g., the server 110). When a user intends to drive a vehicle to a destination, the navigation system may provide a navigation service for the user and during the navigation service, the navigation system may periodically obtain GPS information of the vehicle from a GPS device integrated in the user terminal. Further, the navigation system may generate traffic control parameters associated with a traffic light based on the GPS information according to the process and/or method described in this disclosure.

Figure 2:
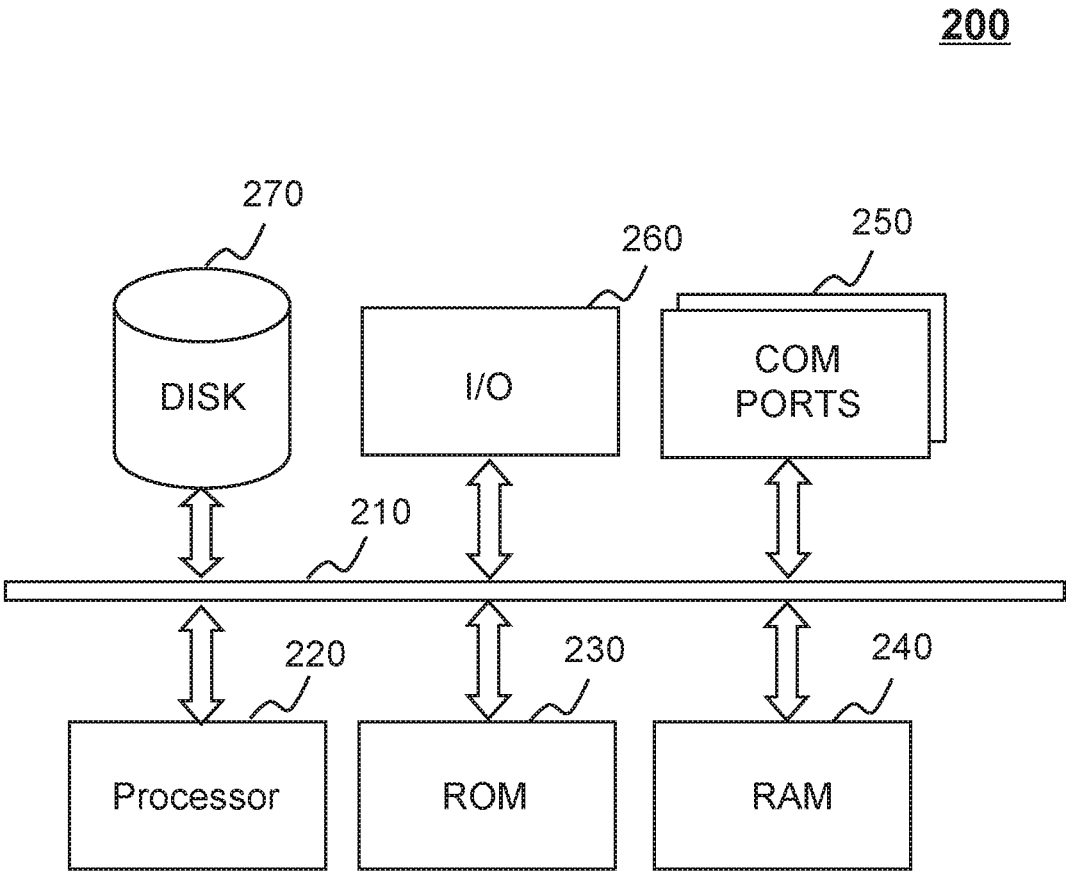
FIG. 2 is a schematic diagram illustrating exemplary hardware and/or software components of an exemplary computing device according to some embodiments of the present disclosure.

FIG. 2 is a schematic diagram illustrating exemplary hardware and software components of a computing device 200 on which the server 110, the requestor terminal 130, and/or the provider terminal 140 may be implemented according to some embodiments of the present disclosure. For example, the processing engine 112 may be implemented on the computing device 200 and configured to perform functions of the processing engine 112 disclosed in this disclosure.

The computing device 200 may be used to implement any component of the on-demand service system 100 as described herein. For example, the processing engine 112 may be implemented on the computing device 200, via its hardware, software program, firmware, or a combination thereof. Although only one such computer is shown, for convenience, the computer functions relating to the on-demand service as described herein may be implemented in a distributed fashion on a number of similar platforms, to distribute the processing load.

The computing device 200, for example, may include COM ports 250 connected to and from a network connected thereto to facilitate data communications. The computing device 200 may also include a processor (e.g., the processor 220), in the form of one or more processors (e.g., logic circuits), for executing program instructions. For example, the processor may include interface circuits and processing circuits therein. The interface circuits may be configured to receive electronic signals from a bus 210, wherein the electronic signals encode structured data and/or instructions for the processing circuits to process. The processing circuits may conduct logic calculations, and then determine a conclusion, a result, and/or an instruction encoded as electronic signals. Then the interface circuits may send out the electronic signals from the processing circuits via the bus 210.

The exemplary computing device may also include an internal communication bus 210, program storage and data storage of different forms including, for example, a disk 270, and a read only memory (ROM) 230, or a random access memory (RAM) 240, for various data files to be processed and/or transmitted by the computing device. The exemplary computing device may also include program instructions stored in the ROM 230, RAM 240, and/or other type of non-transitory storage medium to be executed by the processor 220. The methods and/or processes of the present disclosure may be implemented as the program instructions. The computing device 200 also includes an I/O component 260, supporting input/output between the computer and other components. The computing device 200 may also receive programming and data via network communications.

Merely for illustration, only one CPU and/or processor is illustrated in FIG. 2. Multiple CPUs and/or processors are also contemplated; thus operations and/or method steps performed by one CPU and/or processor as described in the present disclosure may also be jointly or separately performed by the multiple CPUs and/or processors. For example, if in the present disclosure the CPU and/or processor of the computing device 200 executes both step A and step B, it should be understood that step A and step B may also be performed by two different CPUs and/or processors jointly or separately in the computing device 200 (e.g., the first processor executes step A and the second processor executes step B, or the first and second processors jointly execute steps A and B).

Figure 3:
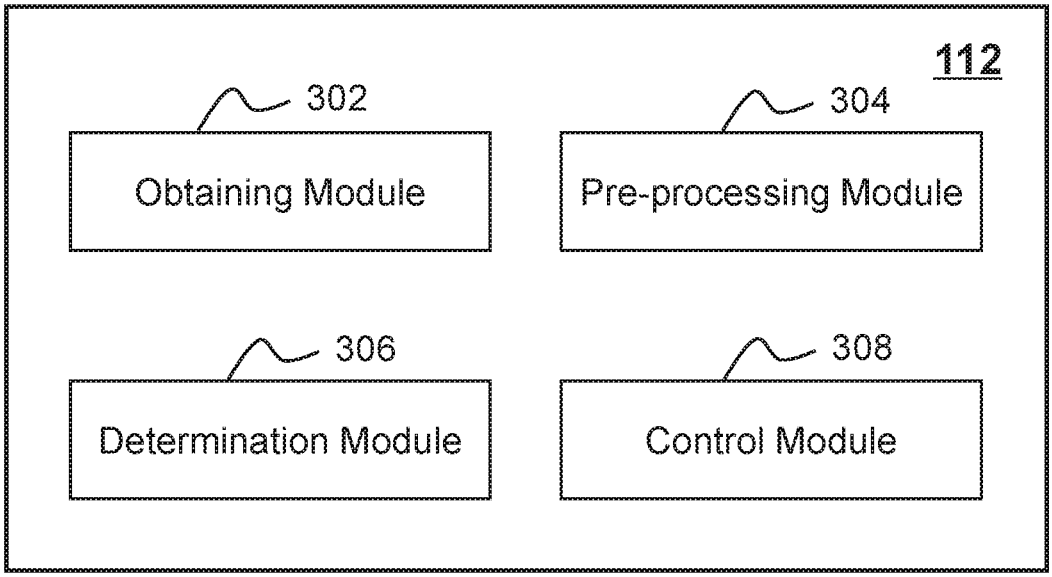
FIG. 3 is a block diagram illustrating an exemplary processing engine according to some embodiments of the present disclosure.

FIG. 3 is a block diagram illustrating an exemplary processing engine 112 according to some embodiments of the present disclosure. The processing engine 112 may include an obtaining module 302, a pre-processing module 304, a determination module 306, and a control module 308.

The obtaining module 302 may be configured to obtain GPS information associated with one or a plurality of vehicles. The obtaining module 302 may obtain the GPS information from the provider terminal 140 or the storage 150 via the network 120. The obtaining module 302 may obtain the GPS information periodically (e.g., per second) or in real time. The obtaining module 302 may transmit the GPS information to the pre-processing module 304 to be further pre-processed.

The pre-processing module 304 may be configured to pre-process the GPS information. In some embodiments, the processing engine 112 may filter noise(s) or correct error(s) in the GPS information. In some embodiments, the pre-processing module 304 may extract GPS information associated with a traffic-regulated section in a specific time period (e.g., Monday to Friday of last week, the last month) from the obtained GPS information. As used herein, a traffic-regulated section may refer to a section of a road facing a specific traffic control (e.g., a traffic light, a traffic police who is directing traffic) at a specific intersection. In some embodiments, the traffic-regulated section may also be further limited to a specific direction (e.g. going forward, turning left, turning right). The pre-processing module 304 may further define a plurality of time intervals (e.g., a morning peak interval, an evening peak interval, a flat interval) and extract GPS information within the plurality of time intervals in the specific time period (e.g., Monday to Friday of last week). In some embodiments, the pre-processing module 304 may determine driving track information of one or a plurality of vehicles in the traffic-regulated section within a specific time interval (e.g., the morning peak interval) based on the extracted GPS information.

The determination module 306 may be configured to determine a plurality of traffic parameters based on the pre-processed GPS information. The plurality of traffic parameters may include a length of a queue (also referred to as a "queue length") in the traffic-regulated section, an aggregation rate of the queue, a dissipation rate of the queue, and an average passing rate of the queue, etc.

The control module 308 may be configured to generate a plurality of control parameters associated with a traffic light based on the plurality of traffic parameters. It should be noted that a "traffic light" in this disclosure refers to a set of lights (e.g. a red light, a green light, and a yellow light) that as a group control a traffic-regulated section. The plurality of control parameters may include a cycle time of a traffic light, a ratio of a green light time to the cycle time of the traffic light, a phase design of a plurality of traffic lights at an intersection, etc. It should be noted that herein "traffic light" is used as an example for all traffic control designs. While traffic can be controlled by traffic lights, it can also be controlled by other technology. In general, however, all the traffic control designs involve signals that allow the vehicles to pass (i.e. corresponding to the green light) and signals that request the vehicles to stop (i.e. corresponding to the red light). The "traffic light", "green light", "red light", and "yellow light" herein used represent all the traffic control signals that serve similar functions.

The modules in the processing engine 112 may be connected to or communicate with each other via a wired connection or a wireless connection. The wired connection may include a metal cable, an optical cable, a hybrid cable, or the like, or any combination thereof. The wireless connection may include a Local Area Network (LAN), a Wide Area Network (WAN), a Bluetooth, a ZigBee, a Near Field Communication (NFC), or the like, or any combination thereof. Two or more of the modules may be combined into a single module, and any one of the modules may be divided into two or more units. For example, the pre-processing module 304 and the determination module 306 may be combined as a single module which may pre-process the GPS information and determine the plurality of traffic parameters based on the pre-processed GPS information. As another example, the processing engine 112 may include a storage module (not shown) used to store the GPS information, the plurality of traffic parameters, the plurality of control parameters, and/or any information associated with traffic light control.

Figure 4:
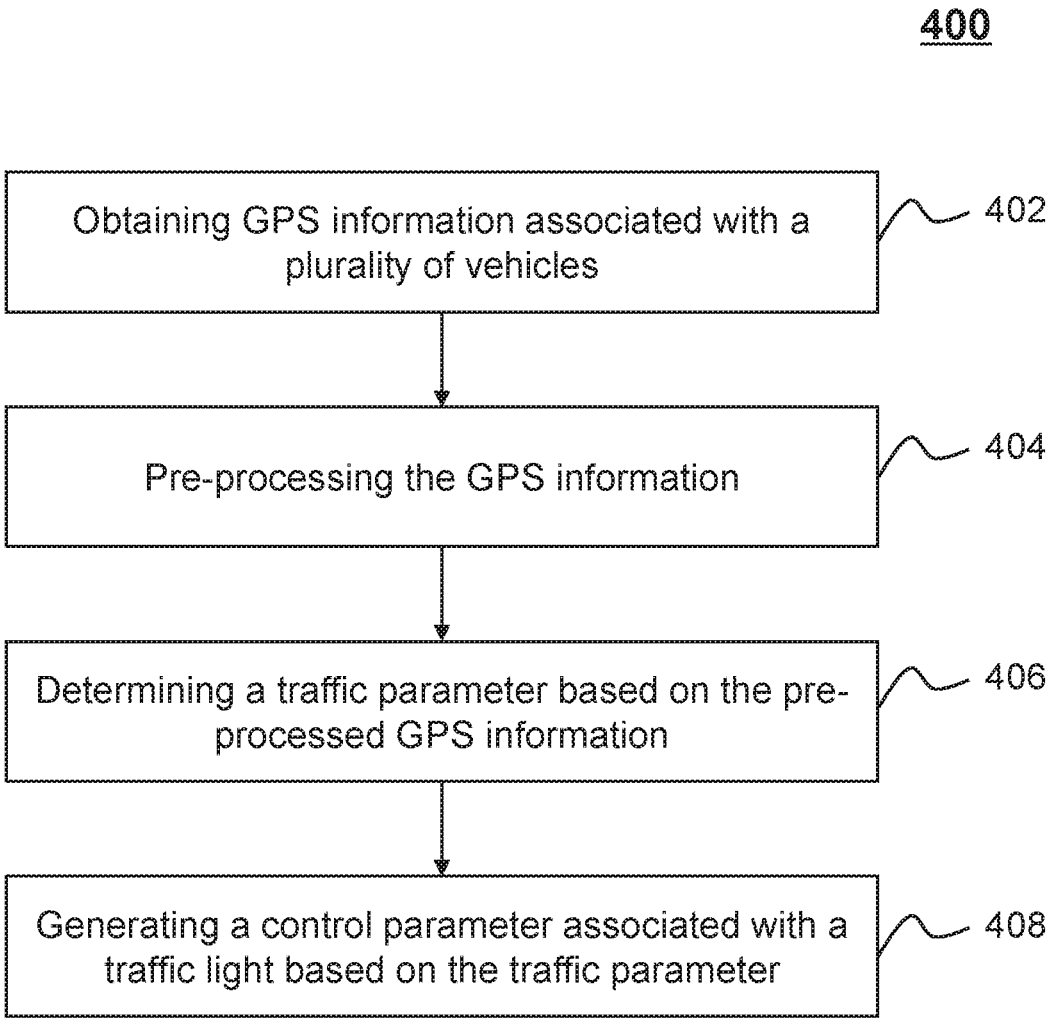
FIG. 4 is a flowchart illustrating an exemplary process for generating a plurality of control parameters associated with a traffic light according to some embodiments of the present disclosure.

FIG. 4 is a flowchart illustrating an exemplary process for generating a plurality of control parameters associated with a traffic light according to some embodiments of the present disclosure. The process 400 may be executed by the on-demand service system 100. For example, the process 400 may be implemented as a set of instructions (e.g., an application) stored in the storage ROM 230 or RAM 240. The processor 220 may execute the set of instructions, and when executing the instructions, it may be configured to perform the process 400. The operations of the illustrated process presented below are intended to be illustrative. In some embodiments, the process 400 may be accomplished with one or more additional operations not described and/or without one or more of the operations discussed. Additionally, the order in which the operations of the process as illustrated in FIG. 4 and described below is not intended to be limiting.

In step 402, the processing engine 112 (e.g., the obtaining module 302) (e.g., the interface circuits of the processor 220) may obtain GPS information associated with a plurality of vehicles. The processing engine 112 may obtain the GPS information from the provider terminal 140 or the storage 150 via the network 120.

For example, when a service provider is providing a transportation service for a requestor by a vehicle, the processing engine 112 may obtain GPS information of the vehicle which indicates a current location of the vehicle from the provider terminal 140 periodically (e.g., per second) or in real time. Further, the processing engine 112 may store the GPS information in a storage device (e.g., the storage 150) disclosed elsewhere in the present disclosure.

In step 404, the processing engine 112 (e.g., the pre-processing module 304) (e.g., the processing circuits of the processor 220) may pre-process the GPS information.

In some embodiments, the processing engine 112 may filter noise(s) or correct error(s) in the GPS information. For example, the processing engine 112 may correct a drifting point in the GPS information.

In some embodiments, the processing engine 112 may extract GPS information associated with a traffic-regulated section in a specific time period (e.g., Monday to Friday of last week, the last month) from the obtained GPS information. As used herein, a traffic-regulated section may refer to a section of a road facing a specific traffic control (e.g., a traffic light, a traffic police who is directing traffic) at a specific intersection. In some embodiments, the traffic-regulated section may also be further limited to a specific direction (e.g. going forward, turning left, turning right). The processing engine 112 may further define a plurality of time intervals (e.g., a morning peak interval, an evening peak interval, a flat interval) and extract GPS information associated with the traffic-regulated section within the plurality of time intervals in the specific time period. For example, the processing engine 112 may define "7:00 a.m.~9:00 a.m." as a morning peak interval, "17:00 p.m.~19:00 p.m." as an evening peak interval, and a time interval other than the above time intervals as a flat interval.

In some embodiments, the processing engine 112 may determine driving track information of a plurality of vehicles in the traffic-regulated section within a specific time interval (e.g., the morning peak interval) in the specific time period (e.g., Monday to Friday of last week) based on the extracted GPS information.

In step 406, the processing engine 112 (e.g., the pre-processing module 304 or the determination module 306) (e.g., the processing circuits of the processor 220) may determine a plurality of traffic parameters based on the pre-processed GPS information. For example, the processing engine 112 may determine a length of a queue in a traffic-regulated section based on the pre-processed GPS information. As another example, the processing engine 112 may determine a rate (e.g., an aggregation rate of the queue, a dissipation rate of the queue, an average passing rate of the queue) of the queue based on driving track information of a plurality of vehicles in the traffic-regulated section.

In step 408, the processing engine 112 (e.g., the control module 308) (e.g., the processing circuits of the processor 220) may generate a plurality of control parameters associated with a traffic light based on the plurality of traffic parameters. For example, the processing engine 112 may determine a target function associated with a plurality of control parameters for a traffic-regulated section. Further, the processing engine 112 may determine a target condition based on the plurality of traffic parameters and generate the plurality of control parameters associated with a traffic light (e.g., a cycle time of the traffic light, a ratio of a green light time to the cycle time) corresponding to the traffic-regulated section based on the target function and the target condition.

For illustration purposes, the present disclosure takes a single traffic-regulated section as an example, it should be noted that the processing engine 112 may extract GPS information associated with a plurality of traffic-regulated sections at a specific intersection and generate control parameters associated with a plurality of traffic lights corresponding to the plurality of traffic-regulated sections. For example, for an intersection at a crossroad, there may be 8 traffic flows (see, e.g., FIG. 13-A and the description thereof) or 12 traffic flows (see, e.g., FIG. 13-B and the description thereof), accordingly the processing engine 112 may determine 8 or 12 traffic-regulated sections; for an intersection at a T-road, there may be 4 traffic flows, accordingly the processing engine 112 may determine 4 traffic-regulated sections.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, one or more other optional steps (e.g., a storing step) may be added elsewhere in the exemplary process 400. In the storing step, the processing engine 112 may store the GPS information, the traffic parameters, and/or the control parameters in a storage device (e.g., the storage 150) disclosed elsewhere in the present disclosure. As another example, step 402 and step 404 may be combined as a single step in which the processing engine 112 may both obtain and pre-process the GPS information.

Figure 5:
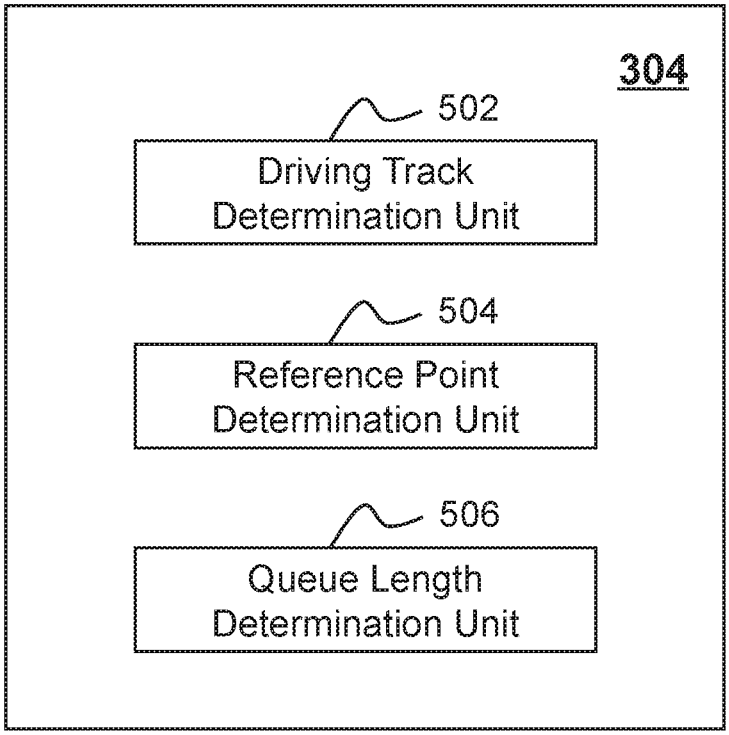
FIG. 5 is a block diagram illustrating an exemplary pre-processing module according to some embodiments of the present disclosure.

FIG. 5 is a block diagram illustrating an exemplary pre-processing module 304 according to some embodiments of the present disclosure. The pre-processing module 304 may include a driving track determination unit 502, a reference point determination unit 504, and a queue length determination unit 506.

The driving track determination unit 502 may be configured to determine driving track information associated with a plurality of vehicles. For example, the driving track determination unit 502 may obtain GPS information of a plurality of vehicles in a traffic-regulated section within a specific time interval (e.g., a morning peak interval) in a specific time period (e.g., Monday to Friday of last week) and match the GPS information to a map (e.g., a Tencent map, a Google map) to determine the driving track information of the plurality of vehicles. As another example, the driving track determination unit 502 may determine a space-time diagram (see, e.g., FIG. 9 and the description thereof) to illustrate the driving track information of the plurality of vehicles.

In some embodiments, the driving track information of the plurality of vehicles may include time point information (e.g., a time point corresponding to a location point in the driving track information), coordinate information, and speed information of each individual vehicle in the plurality of vehicles. In some embodiments, the driving track information may further include ID information (e.g., a name or nickname of a driver, a driving license number of a service provider, or a license plate number of a vehicle), acceleration information, and driving direction information, etc.

The reference point determination unit 504 may be configured to determine a reference point of a traffic-regulated section based on the driving track information. As used herein, in some embodiments, the reference point may refer to a point on a stop line of a traffic-regulated section. In some embodiments, the reference point may refer to a location (or average location) where the first vehicle in a queue stops in a traffic-regulated section.

In some embodiments, the reference point determination unit 504 may determine a queue including a plurality of vehicles in the traffic-regulated section and determine a first position corresponding to the earliest time point in the queue as the reference point. As used herein, when a vehicle's speed is below a pre-determined speed threshold at the traffic-regulated section, it may indicate that the vehicle enters or begins a queue. In some embodiments, the reference point determination unit 504 may determine a plurality of queues at a plurality of time points and determine the reference point based on the plurality of queues according to a clustering algorithm.

The queue length determination unit 506 may be configured to determine a length of a queue in the traffic-regulated section based on the reference point.

In some embodiments, the queue length determination unit 506 may determine a first queuing point at the tail of the queue and determine the length of the queue based on the first queuing point and the reference point. As used herein, the first queuing point is a position of a vehicle entering the queue at a time point when the traffic light turns from red to green or a position of a last vehicle in the queue at the time point when the traffic light turns from red to green.

In some embodiments, the queue length determination unit 506 may determine a link corresponding to the traffic-regulated section, determine a first projection point of the first queuing point on the link and a second projection point of the reference point on the link, and determine the length of the queue based on the first projection point and the second projection point. As used herein, a "link" may refer to a centerline of the traffic-regulated section.

For illustration purposes, the present disclosure takes a single queue as an example, it should be noted that the queue length determination unit 506 may determine an average length of a plurality of queues in the traffic-regulated section within the specific time interval (e.g., the morning peak interval) in the specific time period (e.g., Monday to Friday of last week).

It should be noted that the above description is provided for the purpose of illustration, and not intended to limit the scope of the present disclosure. For persons having ordinary skills in the art, two or more of the units may be combined into a single module, and any one of the units may be divided into two or more sub-units. Various variations and modifications may be conducted under the teaching of the present disclosure. However, those variations and modifications may not depart from the spirit and scope of this disclosure. For example, the driving track determination unit 502 and the reference point determination unit 504 may be combined as a single module which may both determine driving track information of a plurality of vehicles in a traffic-regulated section and a reference point of the traffic-regulated section. As another example, the pre-processing module 304 may include a storage unit (not shown) which may be used to store any information (e.g., the driving track information, the reference point, the length of the queue) associated with the plurality of vehicles in the traffic-regulated section. As a further example, the queue length unit 506 may be integrated in the determination module 306.

Figure 6:
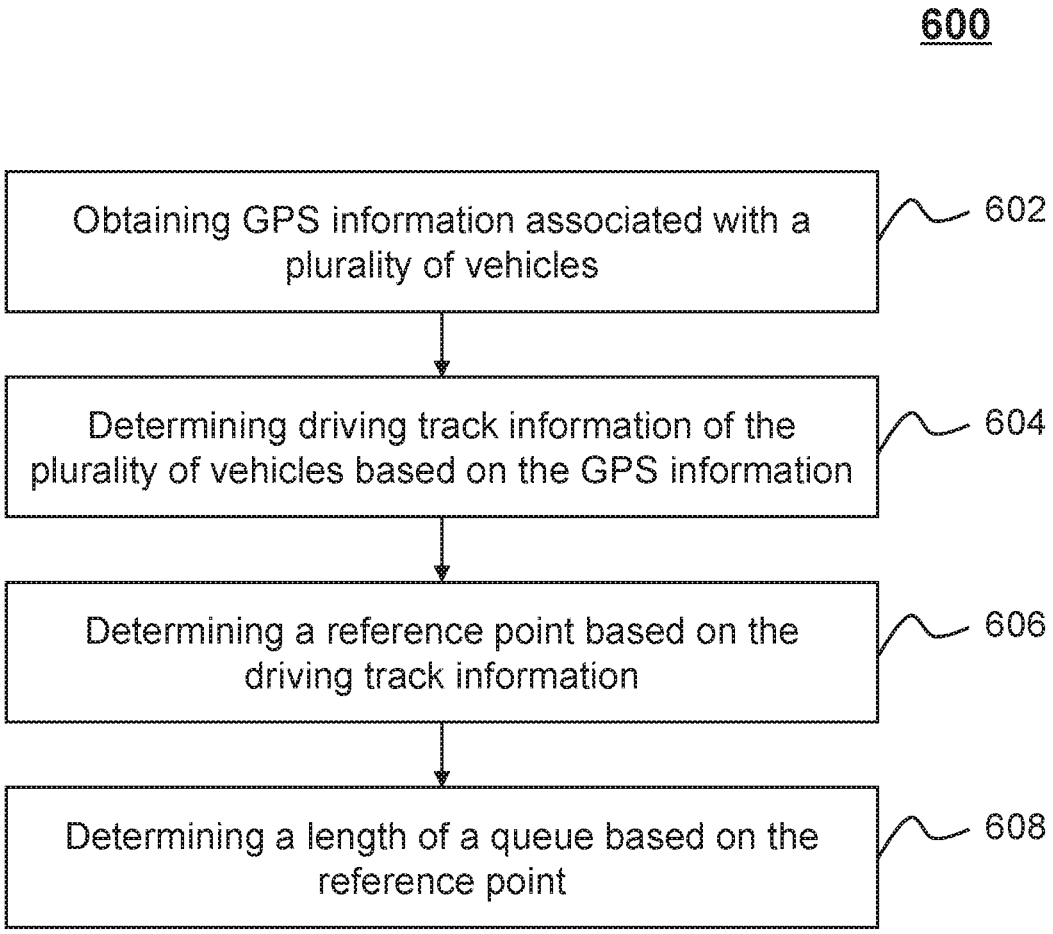
FIG. 6 is a flowchart illustrating an exemplary process for determining a length of a queue for a traffic-regulated section according to some embodiments of the present disclosure.

FIG. 6 is a flowchart illustrating an exemplary process for determining a length of a queue according to some embodiments of the present disclosure. In some embodiments, step 404 and/or step 406 of process 400 may be performed based on the process 600. The process 600 may be executed by the on-demand service system 100. For example, the process 600 may be implemented as a set of instructions (e.g., an application) stored in the storage ROM 230 or RAM 240. The processor 220 may execute the set of instructions and, when executing the instructions, it may be configured to perform the process 600. The operations of the illustrated process presented below are intended to be illustrative. In some embodiments, the process 600 may be accomplished with one or more additional operations not described and/or without one or more of the operations discussed. Additionally, the order in which the operations of the process as illustrated in FIG. 6 and described below is not intended to be limiting.

In step 602, the processing engine 112 (e.g., the driving track determination unit 502) (e.g., the interface circuits of the processor 220) may obtain GPS information associated with one or a plurality of vehicles. The processing engine 112 may obtain the GPS information from a storage device (e.g., the storage 150) disclosed elsewhere in the present disclosure. As described in connection with step 402, the processing engine 112 may obtain GPS information associated with one or a plurality of vehicles in a traffic-regulated section within a specific time interval (e.g., a morning peak interval) in a specific time period (e.g., Monday to Friday of last week).

In step 604, the processing engine 112 (e.g., the driving track determination unit 504) (e.g., the processing circuits of the processor 220) may determine driving track information of the plurality of vehicles based on the GPS information.

For example, the processing engine 112 may match GPS information of the plurality of vehicles in the traffic-regulated section to a map (e.g., a Tencent map, a Google map) to determine the driving track information of the plurality of vehicles. As another example, the processing engine 112 may determine a space-time diagram (see, e.g., FIG. 9 and the description thereof) to illustrate the driving track information of the plurality of vehicles.

In some embodiments, the driving track information of the plurality of vehicles may include time point information (e.g., a time point corresponding to a location point in the driving track information), coordinate information, and speed information of each individual vehicle in the plurality of vehicles. In some embodiments, the driving track information may further include ID information (e.g., a name or nickname of a driver, a driving license number of a service provider, a license plate number of a vehicle), acceleration information, and driving direction information, etc.

In step 606, the processing engine 112 (e.g., the reference point determination unit 506) (e.g., the processing circuits of the processor 220) may determine a reference point based on the driving track information. As used herein, in some embodiments, the reference point may refer to a point on a stop line of a traffic-regulated section. In some embodiments, the reference point may refer to a location (or average location) where the first vehicle in a queue stops in a traffic-regulated section.

In some embodiments, the processing engine 112 may determine a queue including a plurality of vehicles in the traffic-regulated section and determine a first position corresponding to the earliest time point in the queue as the reference point. As used herein, when a vehicle's speed is at or below a pre-determined speed threshold at the traffic-regulated section, it may indicate that the vehicle enters or begins a queue. For example, the speed threshold may be set at 0 m/s, 0.1 m/s, 0.5 m/s, 1 m/s, 2 m/s, 5 m/s, or 10 m/s, or any other value that is deemed practical or indicative for a specific intersection or a specific traffic-regulated section. The processing engine 112 may determine that a vehicle is stopping at the intersection (in the traffic-regulated section), thus indicating that the vehicle is entering or beginning a queue.

In some embodiments, the processing engine 112 may rank a plurality of GPS points corresponding to the plurality of vehicles in the queue chronologically and select the first one corresponding to the earliest time point as the reference point. It should be noted that in some embodiments, the processing engine 112 obtains the GPS information of all the vehicles in a queue. However, in some embodiment, the processing engine 112 does not obtain the GPS information of all the vehicles in a queue but only a number of vehicles in the queue, or a number of vehicles in a plurality of queues in the traffic-regulated section. In some embodiments, the processing engine 112 may determine a plurality of queues at a plurality of time points and determine the reference point based on the plurality of queues according to a clustering algorithm. In some embodiments, the plurality of queues are from the same time interval (e.g. morning peak hours), providing an indicator of the traffic status (e.g. queuing) for the traffic-regulated section or the intersection as whole.

In some embodiments, the reference point may be determined by obtaining known coordinates for a stop line in the traffic-regulated section. In certain embodiments, the coordinates of the stop line may be altered by a predetermined formula to determine the reference point.

For illustration purposes, the present disclosure takes a single traffic-regulated section as an example, it should be noted that the processing engine 112 may determine a plurality of traffic-regulated sections corresponding to a plurality of traffic flows at the intersection. Accordingly, the processing engine 112 may determine a plurality of reference points for the plurality of traffic-regulated sections.

In step 608, the processing engine 112 (e.g., the queue length determination unit 506) (e.g., the processing circuits of the processor 220) may determine a length of a queue in the traffic-regulated section partly based on the reference point.

In some embodiments, the processing engine 112 may determine the length of the queue based on the reference point and a first queuing point at the tail of the queue. As used herein, the first queuing point is a position of a vehicle entering the queue at a time point when the traffic light turns from red to green or a position of a last vehicle in the queue at the time point when the traffic light turns from red to green. For example, the processing engine 112 may determine a distance between the reference point and the first queuing point as the length of the queue.

In some embodiments, the processing engine 112 may determine a link corresponding to the traffic-regulated section, determine a first projection point of the first queuing point on the link and a second projection point of the reference point on the link, and determine the length of the queue based on the first projection point and the second projection point. As used herein, a "link" may refer to a centerline of the traffic-regulated section.

For illustration purposes, the present disclosure takes a single queue in a traffic-regulated section as an example, it should be noted that the processing engine 112 may determine a plurality of queues in the traffic-regulated section within the specific time interval (e.g., the morning peak interval) in the specific time period (e.g., Monday to Friday of last week). Further, the processing engine 112 may determine an average length of the plurality of queues in the traffic-regulated section within the specific time interval (e.g., the morning peak interval) in the specific time period (e.g., Monday to Friday of last week). In some embodiments, the term "queue length" refers to the average length of the plurality of queues in the traffic-regulated section in the specific time period.

For illustration purposes, the present disclosure takes a single traffic-regulated section as an example, it should be noted that the processing engine 112 may determine a plurality of traffic-regulated sections at an intersection. Accordingly, the processing engine 112 may determine a plurality of average queue lengths for the plurality of traffic-regulated sections.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, one or more other optional steps (e.g., a storing step) may be added elsewhere in the exemplary process 600. In the storing step, the processing engine 112 may store the driving track information, the reference point, and/or the length of the queue in any storage device (e.g., the storage 150) disclosed elsewhere in the present disclosure.

Figure 7:
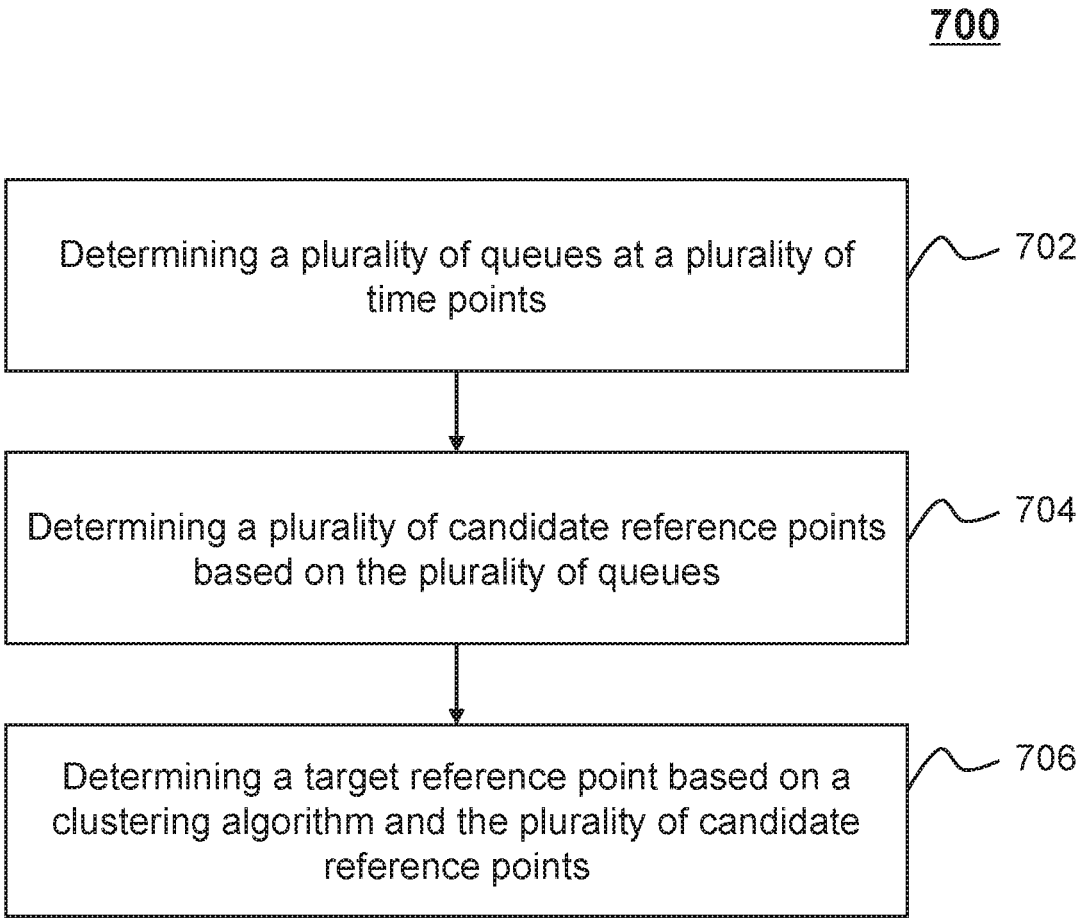
FIG. 7 is a flowchart illustrating an exemplary process for determining a reference point of a traffic-regulated section according to some embodiments of the present disclosure.

FIG. 7 is a flowchart illustrating an exemplary process for determining a reference point according to some embodiments of the present disclosure. In some embodiments, step 606 of process 600 may be performed based on the process 700. The process 700 may be executed by the on-demand service system 100. For example, the process 700 may be implemented as a set of instructions (e.g., an application) stored in the storage ROM 230 or RAM 240. The processor 220 may execute the set of instructions and, when executing the instructions, it may be configured to perform the process 700. The operations of the illustrated process presented below are intended to be illustrative. In some embodiments, the process 700 may be accomplished with one or more additional operations not described and/or without one or more of the operations discussed. Additionally, the order in which the operations of the process as illustrated in FIG. 7 and described below is not intended to be limiting.

In step 702, the processing engine 112 (e.g., the reference point determination unit 504) (e.g., the processing circuits of the processor 220) may determine a plurality of queues at a plurality of time points in a traffic-regulated section.

In step 704, the processing engine 112 (e.g., the reference point determination unit 504) (e.g., the processing circuits of the processor 220) may determine a plurality of candidate reference points based on the plurality of queues. For example, for each of the plurality of queues, the processing engine 112 may rank a plurality of GPS points in the queue chronologically and determine a position corresponding to the earliest time point as a reference point.

In step 706, the processing engine 112 (e.g., the reference point determination unit 504) (e.g., the processing circuits of the processor 220) may determine a target reference point based on a clustering algorithm and the plurality of candidate reference points. The clustering algorithm may include a K-MEANS algorithm, a K-MEDOIDS algorithm, a CLARANS algorithm, etc.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, one or more other optional steps (e.g., a storing step) may be added elsewhere in the exemplary process 700.

Figure 8:
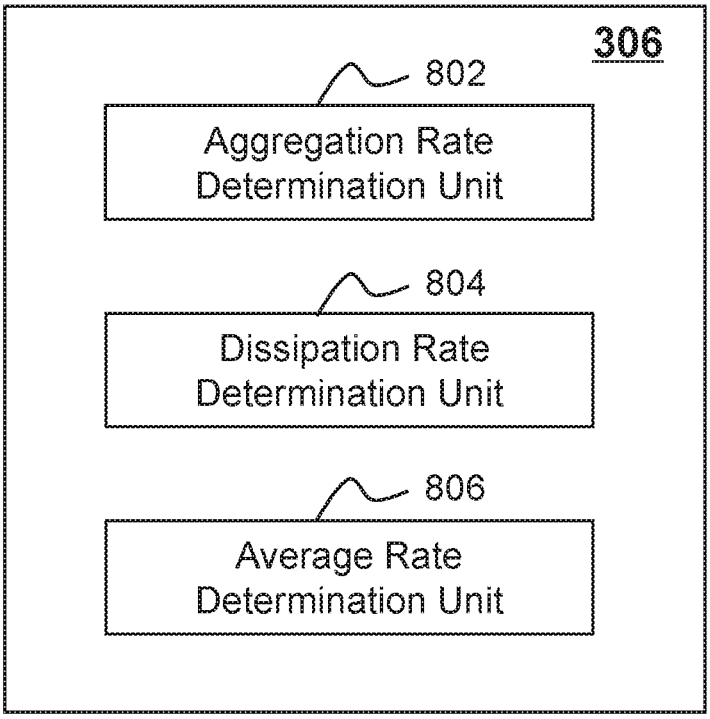
FIG. 8 is a block diagram illustrating an exemplary determination module according to some embodiments of the present disclosure.

FIG. 8 is a block diagram illustrating an exemplary determination module 306 according to some embodiments of the present disclosure. The determination module 306 may include an aggregation rate determination unit 802, a dissipation rate determination unit 804, and an average rate determination unit 806.

The aggregation rate determination unit 802 may be configured to determine an aggregation rate of a queue in a traffic-regulated section. The aggregation rate may refer to a global rate of a queue to form after the traffic light turns to red. In some embodiments, the aggregation rate determination unit 802 may determine the aggregation rate of the queue based on the driving track information of the plurality of vehicles in the queue.

In some embodiments, the aggregation rate determination unit 802 may determine the aggregation rate according to the shock wave theory. As used herein, a "wave" may refer to that when a medium receives a perturbation, the status of the medium may be changed based on the perturbation, and then the medium spreads the perturbation, which forms a wave. Further, a "shock wave" may refer to a wave in which the perturbation is rapid and a leap may occur during the change of the status of the medium. It can be seen that a plurality of vehicles may aggregate and/or dissipate in the traffic-regulated section with the control of the traffic light, which is similar to a "shock wave". In some embodiments, the aggregation rate determination unit 802 may project a plurality of driving tracks of the plurality of vehicles on a space-time diagram (see, e.g., FIG. 9 and the description thereof) and determine the aggregation rate based on the space-time diagram according to the shock wave theory.

In some embodiments, the dissipation rate determination unit 804 may be configured to determine a dissipation rate of a queue in the traffic-regulated section. In some embodiments, the dissipation rate may refer to a global rate of a queue to dissolve after the traffic light turns to green. In some embodiments, the dissipation rate determination unit 802 may determine the dissipation rate of the queue based on the driving track information of the plurality of vehicles in the queue (e.g. based on a space-time diagram; see, e.g., FIG. 9 and the description thereof). In some embodiments, the dissipation rate determination unit 804 may determine the dissipation rate according to the shock wave theory.

The average rate determination unit 806 may be configured to determine an average passing rate of the queue in the traffic-regulated section. The average passing rate may refer to an average speed of a plurality of vehicles included in the queue to leave the queue the traffic light turns to green. For each of the plurality of vehicles in the queue, the average rate determination unit 806 may determine a speed of the vehicle from the vehicle's stopped location to the reference point during the time slot. Further, the average rate determination unit 806 may average a plurality of speeds corresponding to the plurality of vehicles to determine the average passing rate of the queue.

For illustration purposes, the present disclosure takes a single queue in a traffic-regulated section as an example, it should be noted that the processing engine 112 may determine a plurality of queues in the traffic-regulated section within the specific time interval (e.g., the morning peak interval) in the specific time period (e.g., Monday to Friday of last week). Further, the aggregation rate determination unit 802 may determine an average aggregation rate of the plurality of queues in traffic-regulated section within the specific time interval (e.g., the morning peak interval) in the specific time period (e.g., Monday to Friday of last week). Similarly, the dissipation rate determination unit 804 may determine an average dissipation rate of the plurality of queues in the traffic-regulated section within the specific time interval (e.g., the morning peak interval) in the specific time period (e.g., Monday to Friday of last week). The average rate determination unit 806 may determine an average "average passing rate" of plurality of queues in the traffic-regulated section within the specific time interval (e.g., the morning peak interval) in the specific time period (e.g., Monday to Friday of last week).

For illustration purposes, the present disclosure takes a single traffic-regulated section as an example, it should be noted that the processing engine 112 may determine a plurality of traffic-regulated sections at an intersection. Accordingly, the aggregation rate determination 802 may determine a plurality of average aggregation rates for the plurality of traffic-regulated sections. Similarly, the dissipation rate determination unit 804 may determine a plurality of average dissipation rates for the plurality of traffic-regulated sections. The average rate determination unit 806 may also determine a plurality of average "average passing rates" for the plurality of traffic-regulated sections.

The units in the determination module 306 may be connected to or communicate with each other via a wired connection or a wireless connection. The wired connection may include a metal cable, an optical cable, a hybrid cable, or the like, or any combination thereof. The wireless connection may include a Local Area Network (LAN), a Wide Area Network (WAN), a Bluetooth, a ZigBee, a Near Field Communication (NFC), or the like, or any combination thereof. Two or more of the units may be combined as a single module, and any one of the units may be divided into two or more sub-units. For example, the aggregation rate determination unit 802 and the dissipation rate determination unit 804 may be combined as a single module which may both determine the aggregation rate and/or the dissipation rate of the queue. As another example, the determination module 306 may include a storage unit (not shown) which may be configured to store the aggregation rate, the dissipation rate, and/or the average passing rate of the queue.

Figure 9:
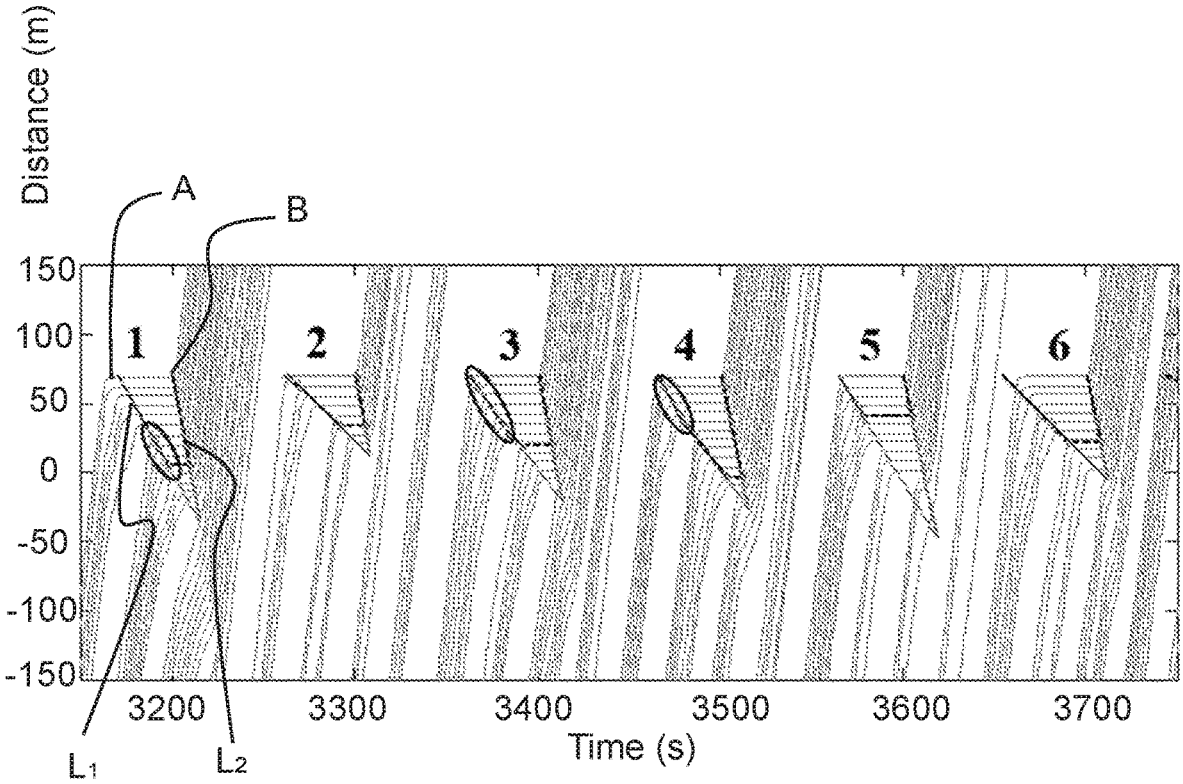
FIG. 9 is a schematic diagram illustrating an exemplary space-time diagram associated with a plurality of vehicles according to some embodiments of the present disclosure.

FIG. 9 is a schematic diagram illustrating an exemplary space-time diagram associated with a plurality of vehicles according to some embodiments of the present disclosure. In some embodiments, the space-time diagram may be a two-dimensional diagram. The horizontal axis represents time and the vertical axis represents distance between a vehicle's location and a reference point of a traffic-regulated section.

As illustrated, in some embodiments, the space-time diagram includes a plurality of curves, and each of the plurality of curves corresponds to a vehicle. A curve corresponding to a vehicle may include a flat segment corresponding to a time slot which indicates that the vehicle's location almost doesn't change during the time slot (i.e., the vehicle has stopped and is likely in a queue). In some embodiments, the flat segment may include a first inflection point (e.g., point A) and a second inflection point (e.g., point B). In certain embodiments, the first inflection point may indicate a time point when the vehicle enters or begins a queue and the second inflection point may indicate a time point when the vehicle leaves the queue.

As illustrated, there are 6 queues marked with "1," "2," "3," "4," "5," and "6". Take queue "1" as an example, the processing engine 112 may determine an aggregation rate of the queue based on a line $L_1$, which connects a plurality of first inflection points. For example, the processing engine 112 may determine an absolute value of the slope of the line $L_1$ as the aggregation rate. The processing engine 112 may determine a dissipation rate of the queue based on a line $L_2$, which connects a plurality of second inflection points. For example, the processing engine 112 may determine an absolute value of the slope of the line $L_2$ as the dissipation rate.

Figure 10:
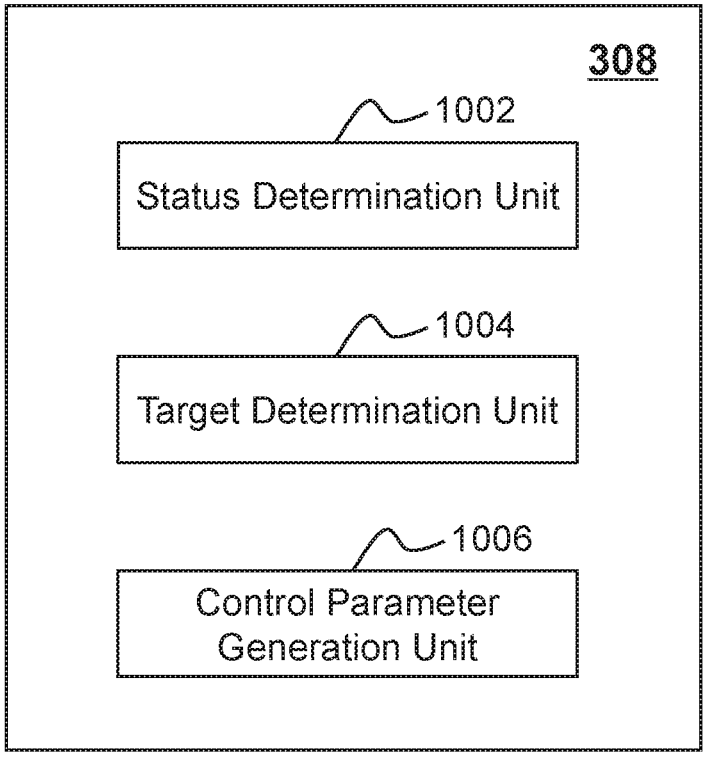
FIG. 10 is a block diagram illustrating an exemplary control module according to some embodiments of the present disclosure.

FIG. 10 is a block diagram illustrating an exemplary control module 308 according to some embodiments of the present disclosure. The control module 308 may include a status determination unit 1002, a target determination unit 1004, and a control parameter generation unit 1006.

The status determination unit 1002 may be configured to determine a traffic status of a traffic-regulated section. The status determination unit 1002 may determine the traffic status of the traffic-regulated section based on a plurality of traffic parameters associated with the traffic-regulated section. The plurality of traffic parameters may include a length of a queue in the traffic-regulated section, an aggregation rate of the queue, a dissipation rate of the queue, an average passing rate of the queue, etc.

As described in connection with FIG. 6 and FIG. 8, the processing engine 112 may determine a plurality of (e.g., 8) traffic-regulated sections corresponding to a plurality of traffic flows at an intersection, accordingly the status determination unit 1002 may determine a global traffic status of the intersection based on traffic parameters of the plurality of traffic-regulated sections. In some embodiments, the status determination unit 1002 may further obtain a plurality of general traffic parameters (e.g., the number of lanes) associated with the intersection.

The target determination unit 1004 may be configured to determine a target condition associated with a target function based on the global traffic status of the intersection. As used herein, the target condition may refer to an optimization goal associated with the global traffic status of the intersection.

The target function may be a non-linear function associated with a plurality of traffic parameters of the plurality of traffic-regulated sections.

The control parameter generation unit 1006 may be configured to generate a plurality of control parameters associated with the plurality of traffic lights for the plurality of traffic-regulated sections based on the plurality of traffic parameters and the target function. The plurality of control parameters may include a cycle time of each traffic light (also referred to as a "target cycle time of a traffic light"), a ratio of a green light time to the cycle time of the traffic light (also referred to as a "target ratio of a green light time to the cycle time of the traffic light"), a phase design (e.g., a target phase sequence) of the plurality of traffic lights, etc.

The units in the control module 308 may be connected to or communicate with each other via a wired connection or a wireless connection. The wired connection may include a metal cable, an optical cable, a hybrid cable, or the like, or any combination thereof. The wireless connection may include a Local Area Network (LAN), a Wide Area Network (WAN), a Bluetooth, a ZigBee, a Near Field Communication (NFC), or the like, or any combination thereof. Two or more of the units may be combined into a single module, and any one of the units may be divided into two or more sub-units. For example, the target determination unit 1004 and the control parameter generation unit 1006 may be combined as a single module which may both determine a target function and a plurality of control parameters based on the target function. As another example, the control module 308 may include a storage unit (not shown) used to store the traffic status, the target function, the target condition, and/or the control parameters.

Figure 11:
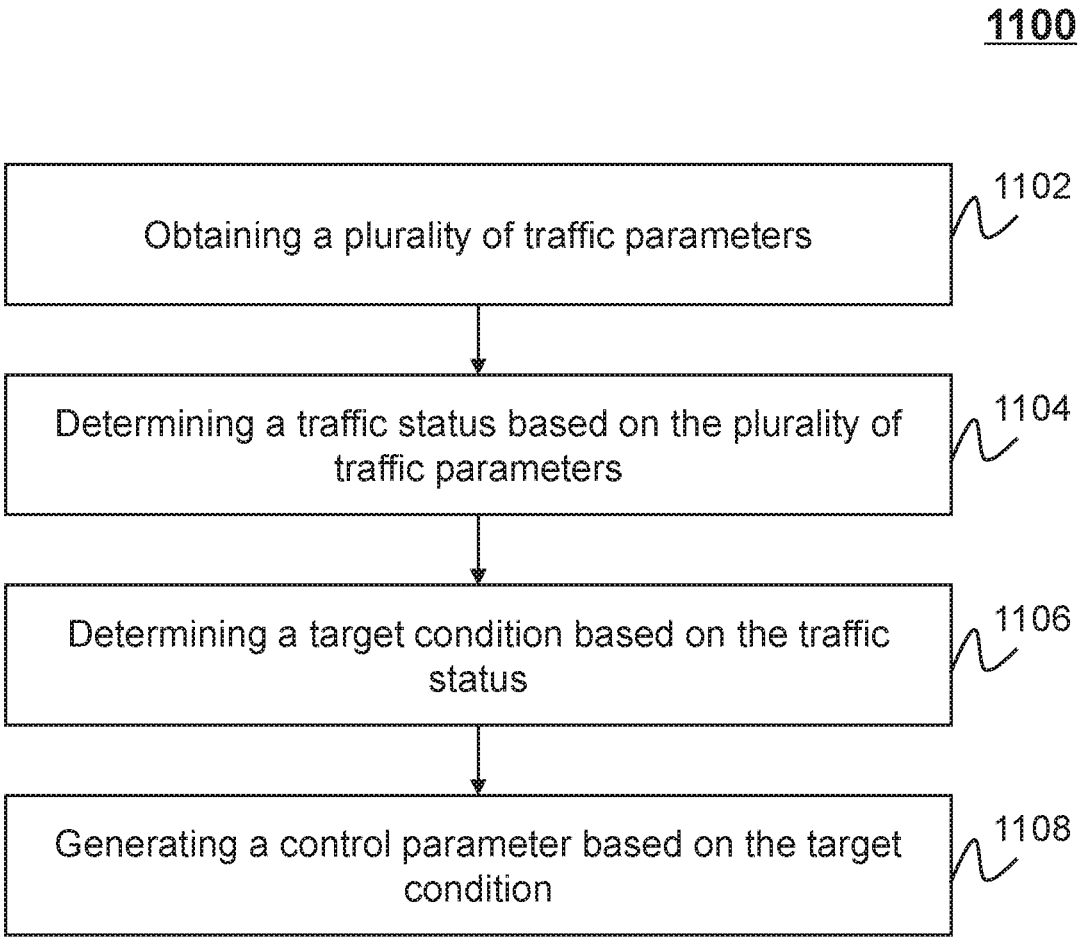
FIG. 11 is a flowchart illustrating an exemplary process for generating one or a plurality of control parameters associated with a traffic light according to some embodiments of the present disclosure.

FIG. 11 is a flowchart illustrating an exemplary process for generating one or a plurality of control parameters associated with a traffic light for a traffic-regulated section based on a plurality of traffic parameters according to some embodiments of the present disclosure. In some embodiments, step 408 of process 400 may be performed based on the process 1100. The process 1100 may be executed by the on-demand service system 100. For example, the process 1100 may be implemented as a set of instructions (e.g., an application) stored in the storage ROM 230 or RAM 240. The processor 220 may execute the set of instructions, and when executing the instructions, it may be configured to perform the process 1100. The operations of the illustrated process presented below are intended to be illustrative. In some embodiments, the process 1100 may be accomplished with one or more additional operations not described and/or without one or more of the operations discussed. Additionally, the order in which the operations of the process as illustrated in FIG. 11 and described below is not intended to be limiting.

In step 1102, the processing engine 112 (e.g., the status determination unit 1002) (e.g., the processing circuits of the processor 220) may obtain one or a plurality of traffic parameters associated with a traffic-regulated section. The processing engine 112 may obtain the one or plurality of traffic parameters from the pre-processing module 304, the determination module 306, or any storage device (e.g., the storage 150) disclosed elsewhere in the present disclosure. The one or plurality of traffic parameters may include a length of a queue in the traffic-regulated section, an aggregation rate of the queue, a dissipation rate of the queue, an average passing rate of the queue, etc. As described elsewhere in the present disclosure, the "length" here may refer to an average queue length, the "aggregation rate" here may refer to an average aggregation rate, the "dissipation rate" may refer to an average dissipation rate, and the "average passing rate" here may refer to an average "average passing rate".

As described in connection with FIG. 6 and FIG. 8, the processing engine 112 may determine a plurality of (e.g., 8) traffic-regulated sections corresponding to a plurality of traffic flows at an intersection, accordingly the processing engine 112 may obtain the above traffic parameters associated with the plurality of traffic-regulated sections. In some embodiments, the processing engine 112 may further obtain a plurality of general traffic parameters (e.g., the number of lanes) associated with the intersection. In some embodiments, the processing engine 112 may further obtain a plurality of general parameters (e.g. weather, nearby special event at the time, etc.) associated with the intersection.

In step 1104, the processing engine 112 (e.g., the status determination unit 1002) (e.g., the processing circuits of the processor 220) may determine a traffic status of the traffic-regulated section based on the plurality of traffic parameters. In some embodiments, the processing engine 112 also takes into consideration other parameters associated with the intersection. As used herein, the "traffic status" may indicate whether the traffic in the traffic-regulated section is supersaturated, whether the traffic in the traffic-regulated section is stable, etc.

For example, the processing engine 112 may determine a dissipation time based on the length of the queue and the dissipation rate of the queue, and determine the traffic status based on the dissipation time. As another example, the processing engine 112 may compare the length of the queue with a preset length threshold (e.g., 90% of the minimum queue length that would cause supersaturation) and determine the traffic status based on the comparison result.

In some embodiments, the processing engine 112 may determine a global traffic status of the intersection based on the traffic parameters of the plurality of traffic-regulated sections at the intersection. For example, if one of the plurality of traffic-regulated sections at the intersection is supersaturated, the global traffic status of the intersection may also be a supersaturated status.

In step 1106, the processing engine 112 (e.g., the target determination unit 1004) (e.g., the processing circuits of the processor 220) may determine a target condition associated with a target function based on the global traffic status of the intersection. As used herein, the target condition may refer to an optimization goal associated with the global traffic status of the intersection. The target function may be a non-linear function associated with a plurality of traffic parameters of the plurality of traffic-regulated sections.

In step 1108, the processing engine 112 (e.g., the control parameter generation unit 1006) (e.g., the processing circuits of the processor 220) may generate a plurality of control parameters associated with a plurality of traffic lights for the plurality of traffic-regulated sections based on the target condition. The plurality of control parameters may include a cycle time of each traffic light (also referred to as a "target cycle time of a traffic light"), a ratio of a green light time to the cycle time of the traffic light (also referred to as a "target ratio of a green light time to the cycle time of the traffic light"), a phase design (e.g., a target phase sequence) of the plurality of traffic lights at the intersection, etc.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, one or more other optional steps (e.g., a storing step) may be added elsewhere in the exemplary process 1100. In the storing step, the processing engine 112 may store the traffic statuses, the target condition, and/or the control parameters in a storage device (e.g., the storage 150) disclosed elsewhere in the present disclosure.

Figure 12:
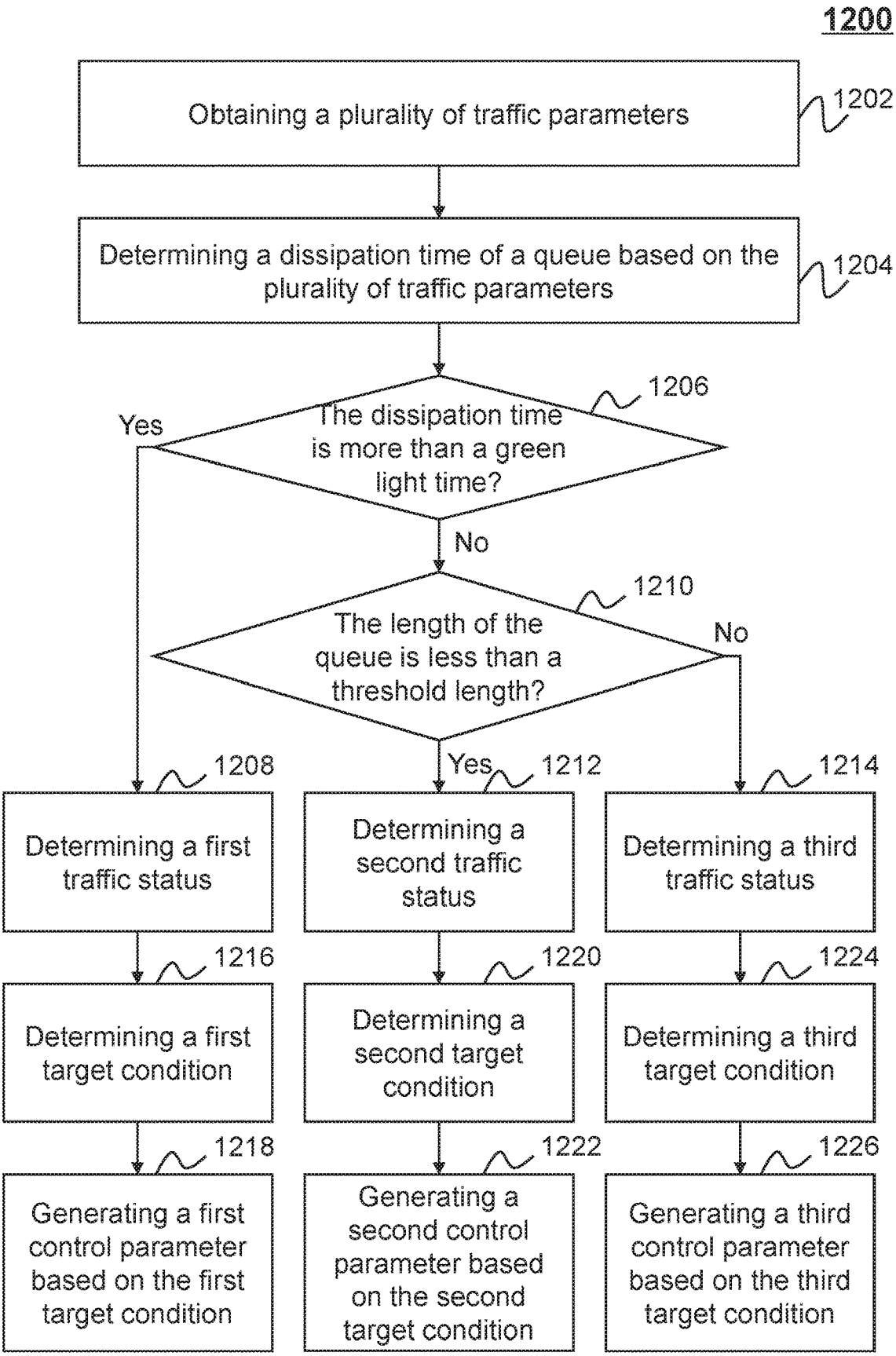
FIG. 12 is a flowchart illustrating an exemplary process for generating a plurality of control parameters associated with a traffic light based on a target condition according to some embodiments of the present disclosure.

FIG. 12 is a flowchart illustrating an exemplary process for generating a plurality of control parameters associated with a traffic light based on a target condition according to some embodiments of the present disclosure. The process 1200 may be executed by the on-demand service system 100. For example, the process 1200 may be implemented as a set of instructions (e.g., an application) stored in the storage ROM 230 and/or RAM 240. The processor 220 may execute the set of instructions and, when executing the instructions, it may be configured to perform the process 1200. The operations of the illustrated process presented below are intended to be illustrative. In some embodiments, the process 1200 may be accomplished with one or more additional operations not described and/or without one or more of the operations discussed. Additionally, the order in which the operations of the process as illustrated in FIG. 12 and described below is not intended to be limiting.

In step 1202, the processing engine 112 (e.g., the status determination unit 1002) (e.g., the processing circuits of the processor 220) may obtain a plurality of traffic parameters. The plurality of traffic parameters may include a length of a queue in the traffic-regulated section, an aggregation rate of the queue, a dissipation rate of the queue, an average passing rate of the queue, etc. As described elsewhere in the present disclosure, the "length" here may refer to an average queue length, the "aggregation rate" here may refer to an average aggregation rate, the "dissipation rate" may refer to an average dissipation rate, and the "average passing rate" here may refer to an average "average passing rate".

As described in connection with FIG. 6 and FIG. 8, the processing engine 112 may determine a plurality of (e.g., 8) traffic-regulated sections corresponding to a plurality of traffic flows at an intersection, accordingly the processing engine 112 may obtain above traffic parameters associated with the plurality of traffic-regulated sections.

In some embodiments, the processing engine 112 may further obtain a plurality of general traffic parameters associated with the intersection. For example, for each of the plurality of traffic flows, the processing engine 112 may obtain time thresholds associated with a traffic light of the traffic flow, a threshold length associated with a queue in a traffic-regulated section along the traffic flow (e.g., 90% of the minimum queue length that would cause supersaturation), etc. As another example, the processing engine 112 may also obtain the number of lanes (e.g., 2, 4) at the intersection, a phase sequence (also referred to as an "original phase sequence") of a plurality of phases corresponding to the plurality of traffic flows, etc.

The time thresholds associated with the traffic light may include a first time threshold (e.g., a maximum red light time, a minimum red light time) associated with a red light of the traffic light, a second time threshold (e.g., a maximum green light time, a minimum green light time) associated with a green light of the traffic light, a third time threshold (e.g., a maximum yellow light time, a minimum yellow light time) associated with a yellow light the traffic light, etc.

In step 1204, the processing engine 112 (e.g., the status determination unit 1002) (e.g., the processing circuits of the processor 220) may determine a dissipation time of the queue in a traffic-regulated section based on the plurality of traffic parameters. As used herein, the dissipation time may refer to a time slot during which the queue may be dissipated. For example, the processing engine 112 may determine the dissipation time based on the length of the queue and the dissipation rate of the queue according to formula (1) below:

$$T_d = \frac{L}{R_d} \tag{1}$$

where L refers to the length of the queue, $R_d$ refers to the dissipation rate of the queue, and $T_d$ refers to the dissipation time.

For illustration purposes, the present disclosure takes a single traffic-regulated section as an example, it should be noted that the processing engine 112 may determine a plurality of dissipation times of the plurality of traffic-regulated sections at the intersection.

In step 1206, for each of the plurality of traffic-regulated sections, the processing engine 112 (e.g., the status determination unit 1002) (e.g., the processing circuits of the processor 220) may determine whether the dissipation time is more than a green light time (also referred to as an "original green light time") of the traffic light of the traffic-regulated section.

In response to the determination that one or more of the plurality of dissipation times are more than the green light time (it should be noted that a dissipation time of a traffic-regulated section should be compared with a green light time of a traffic light corresponding to the traffic-regulated section, and for convenience, "green light time" is collectively used hereafter), the processing engine 112 (e.g., the status determination unit 1002) (e.g., the processing circuits of the processor 220) may execute the process 1200 to step 1208 to determine a first traffic status. The first traffic status may indicate that the traffic of the intersection is supersaturated in which some of vehicles in the queues in one or more traffic-regulated sections still cannot pass through the reference point after the first green light time is terminated.

In some embodiments, in response to the determination that the all the plurality of dissipation times are less than or equal to the green light time, the processing engine 112 (e.g., the status determination unit 1002) (e.g., the processing circuits of the processor 220) may execute the process 1200 to step 1210. In step 1210, for each of the plurality of traffic-regulated sections, the processing engine 112 (e.g., the status determination unit 1002) (e.g., the processing circuits of the processor 220) may determine whether the length of the queue is less than the threshold length (it should be noted that a queue length of a traffic-regulated section should be compared with a threshold length corresponding to the traffic-regulated section, and for convenience, "threshold length" is collectively used hereafter).

In response to the determination that all the plurality of queue lengths are less than the threshold length, the processing engine 112 (e.g., the status determination unit 1002) (e.g., the processing circuits of the processor 220) may execute the process 1200 to step 1212 to determine a second traffic status. The second traffic status may indicate that the traffic of the intersection is non-supersaturated and a global queue status of the intersection is stable in which all the vehicles in the queues in the plurality of traffic-regulated sections can pass through the reference point when the green light time is terminated.

In response to the determination that one or more of the plurality of queue lengths are equal to or larger than the threshold length, the processing engine 112 (e.g., the status determination unit 1002) (e.g., the processing circuits of the processor 220) may execute the process 1200 to step 1214 to determine a third traffic status. The third traffic status may indicate that the traffic of the intersection is non-supersaturated and the global queue status of the intersection is unstable in which one or more queue lengths in one or more traffic-regulated sections exceed the corresponding preset threshold queue length(s).

After determining the traffic status of the intersection, the processing engine 112 (e.g., the target determination unit 1004) (e.g., the processing circuits of the processor 220) may determine a target condition based on the traffic status and generate a plurality of control parameters associated with the plurality of traffic lights at the intersection based on the target condition. The control parameters may be configured to alter the operation of the plurality of traffic lights to optimize traffic at the intersection to reach the target condition.

For example, the processing engine 112 may determine a target function (e.g., a non-linear function) based on the plurality of traffic parameters, and generate a plurality of control parameters based on the target function and the target condition. In some embodiments, the processing engine 112 may further determine a constraint condition of the target function based on the traffic status, and generate a plurality of control parameters based on the target function, the constrain condition, and the target condition.

In step 1216, the processing engine 112 (e.g., the target determination unit 1004) (e.g., the processing circuits of the processor 220) may determine a first target condition based on the first traffic status, wherein the first target condition is to maximize an average number of vehicles that pass a reference point along the plurality of traffic flows at the intersection.

Further, the processing engine 112 may determine a first constraint condition based on the first traffic status as formulas (2) and (3) below:

$$g_i^{min} \le g_i \le g_i^{max},\ i=1,2,\ldots,n, \tag{2}$$

$$C^{min} \le C \le C^{max}. \tag{3}$$

where i refers to a traffic flow (e.g., AB illustrated in FIG. 13), $g_i$ refers to a green light time (also referred to as an "original green light time") of a traffic light along the traffic flow i, $g_i^{min}$ and $g_i^{max}$ refer to a minimum green light time and a maximum green light time of the traffic light along the traffic flow i respectively, C refers to a cycle time (also referred to as an "original cycle time") of the traffic light along the traffic flow i, and $C^{min}$ and $C^{max}$ refer to a minimum cycle time and a maximum cycle time of the traffic light along the traffic flow i respectively.

In some embodiments, as shown in step 1218, the processing engine 112 (e.g., the control parameter generation unit 1006) (e.g., the processing circuits of the processor 220) may generate first control parameters associated with the plurality of traffic lights at the intersection based on the target function, the first target condition, and the first constraint condition. For example, the processing engine 112 may determine an optimal solution of the target function based on the first constraint condition and the first target condition. The first control parameters may include a first target green light time of each traffic light at the intersection, a first target cycle time of each traffic light at the intersection, a first phase design of the plurality of traffic lights at the intersection, etc.

In some embodiments, as shown in step 1220, the processing engine 112 (e.g., the target determination unit 1004) (e.g., the processing circuits of the processor 220) may determine a second target condition based on the second traffic status, wherein the second target condition is to minimize an average delay time of vehicles passing through a reference point along the plurality of traffic flows at the intersection. As used herein, the delay time may refer to a time difference between an actual time period in which vehicles passed through the reference point and a presumptive time period in which the vehicles can pass through the reference point without a traffic light.

Further, the processing engine 112 may determine a second constraint condition based on the second traffic status as formulas (4)-(7):

$$g_i \ge tc_i, \tag{4}$$

$$gl_i^{90} \le QL_i^{max}, \tag{5}$$

$$g_i^{min} \le g_i \le g_i^{max},\ i=1,2,\ldots,n, \tag{6}$$

$$C^{min} \le C \le C^{max}. \tag{7}$$

where $tc_i$ refers to a dissipation time of a queue in a traffic-regulated section along the traffic flow i, $gl_i^{90}$ refers to a length of a queue in the traffic-regulated section along the traffic flow i, $Ql_i^{max}$ refers to a threshold queue length of the traffic flow i.

In step 1222, the processing engine 112 (e.g., the control parameter generation unit 1006) (e.g., the processing circuits of the processor 220) may generate second control parameters associated with the plurality of traffic lights based on the target function, the second target condition, and the second constraint condition. For example, as described in connection with step 1218, the processing engine 112 may determine an optimal solution of the target function based on the second constraint condition and the second target condition. The second control parameters may include a second target green light time of each traffic light at the intersection, a second target cycle time of each traffic light at the intersection, a second phase design of the plurality of traffic lights at the intersection, etc.

In some embodiments, as shown in step 1224, the processing engine 112 (e.g., the target determination unit 1004) (e.g., the processing circuits of the processor 220) may determine a third target condition based on the third traffic status, wherein the third target condition is to minimize a highest ratio of the queue length to the threshold length among the ratios corresponding to the plurality of traffic flows at the intersection.

Further, the processing engine 112 may determine a third constraint condition as formulas (8)-(10) below:

$$g_i \ge tc_i, \tag{8}$$

$$g_i^{min} \le g_i \le g_i^{max},\ i=1,2,\ldots,n, \tag{9}$$

$$C^{min} \le C \le C^{max}. \tag{10}$$

In some embodiments, as shown in step 1226, the processing engine 112 (e.g., the control parameter generation unit 1006) (e.g., the processing circuits of the processor 220) may generate third control parameters associated with the plurality of traffic lights based on the target function, the third target condition, and the third constraint condition. For example, as described in connection with step 1218 or step 122, the processing engine 112 may determine an optimal solution of the target function based on the third constraint condition and the third target condition. The third control parameters may include a third target green light time of each traffic light at the intersection, a third target cycle time of each traffic light at the intersection, a third phase design of the plurality of traffic lights at the intersection, etc.

It should be noted that the above description of the traffic parameter generating process is provided for the purpose of illustration, and not intended to limit the scope of the present disclosure. For persons having ordinary skills in the art, modules may be combined in various ways, or connected with other modules as sub-systems. Various variations and modifications may be conducted under the teaching of the present disclosure. However, those variations and modifications may not depart from the spirit and scope of this disclosure.

FIG. 13-A and FIG. 13-B are schematic diagrams illustrating exemplary traffic flows at an intersection according to some embodiments of the present disclosure. As illustrated in FIG. 13-A, an intersection may include 8 traffic flows including AB, BA, CD, DC, AC, CB, BD, and DA. As illustrated in FIG. 13-B, the intersection may include 12 traffic flows including AB, BA, CD, DC, AC, CB, BD, DA, AD, DB, BC, and CA. Each of the traffic flows may correspond to a traffic-regulated section in which a plurality of queues may occur within a specific time interval (e.g., a morning peak interval). The processing engine 112 may determine a global traffic status of the intersection based on traffic parameters associated with the plurality of traffic-regulated sections and generate control parameters associated with a plurality of traffic lights at the intersection based on the traffic status.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment," "one embodiment," or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "block," "module," "engine," "unit," "component," or "system." Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB. NET, Python or the like, conventional procedural programming languages, such as the "C" programming language, Visual Basic, Fortran 1703, Perl, COBOL 1702, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a software as a service (SaaS).

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution—e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

We claim:

1. A system for traffic light timing, comprising:

at least one storage medium including a set of instructions for generating a control parameter associated with a plurality of traffic lights for a plurality of traffic-regulated sections at an intersection, wherein a traffic light corresponds to a traffic-regulated section;

at least one processor in communication with the at least one storage medium, wherein when executing the set of instructions, the at least one processor is directed to:

obtain a plurality of traffic parameters for the plurality of traffic-regulated sections, wherein the plurality of traffic parameters comprise a queue length of each individual traffic-regulated section in the plurality of traffic-regulated sections, an aggregation rate of the queue, a dissipation rate of the queue, or an average passing rate of the queue;

determine a traffic status of the intersection based on the plurality of traffic parameters, wherein the traffic status of the intersection includes a second traffic status, and the at least one processor is directed to:

determine a plurality of dissipation times of a plurality of queues in the plurality of traffic-regulated sections;

determine whether one of the plurality of dissipation times is more than a first green light time of a first traffic light, wherein the first traffic light corresponds to a first traffic-regulated section which corresponds to the one of the plurality of dissipation times;

determine whether each of the plurality of queue lengths of the plurality of traffic-regulated sections is less than a threshold length in response to the determination that each of the plurality of dissipation time is less than or equal to a green light time of a corresponding traffic light; and determine the second traffic status in response to the determination that each of the plurality of queue lengths is less than the threshold length;

determine a target condition including a second target condition based on the second traffic status of the intersection; and generate the control parameter associated with the plurality of traffic lights based on a target function and the target condition, wherein the control parameter is configured to alter the operation of the plurality of traffic lights to optimize traffic at the intersection to reach the target condition.

2. The system of claim 1, wherein at least one processor is further directed to:

determine the target function based on the plurality of traffic parameters.

3. The system of claim 1, wherein the dissipation time is determined based on the queue length and the dissipation rate of the queue, and a dissipation time corresponds to a traffic-regulated section, the traffic status of the intersection further includes a first traffic status, and the at least one processor is further directed to:

determine the first traffic status in response to the determination that one of the plurality of dissipation times is more than the first green light time of the traffic light.

4. The system of claim 1, wherein the target condition further includes a first target condition, the traffic status of the intersection further includes a first traffic status, and the at least one processor is further directed to:

determine the first target condition based on the first traffic status, wherein the first target condition is to maximize an average number of vehicles that pass through the intersection.

5. The system of claim 1, wherein the second target condition is to minimize an average delay time of vehicles passing through at the intersection.

6. The system of claim 1, wherein the traffic status of the intersection further includes a third traffic status, and the at least one processor is further directed to:

determine the third traffic status in response to the determination that one of the plurality of queue lengths is longer than or equal to the threshold length.

7. The system of claim 6, wherein the at least one processor is further directed to:

determine a third target condition based on the third traffic status, wherein the third target condition is to minimize a highest ratio of the queue length to the threshold length among the ratios corresponding to the traffic-regulated sections at the intersection.

8. The system of claim 1, wherein the control parameter includes a cycle time of each traffic light, a ratio of green light time to cycle time of each traffic light, or a phase design of the plurality of traffic lights.

9. The system of claim 1, wherein the at least one processor is further directed to:

determine a constraint condition based on the traffic status, wherein the control parameter is determined based on the target function and the constraint condition.

10. A method implemented on a computing device having at least one processor, at least one storage medium, and a communication platform connected to a network, the method comprising:

obtaining a plurality of traffic parameters for a plurality of traffic-regulated sections at an intersection, wherein the plurality of traffic parameters comprise a queue length of each individual traffic-regulated section in the plurality of traffic-regulated sections, an aggregation rate of the queue, a dissipation rate of the queue, or an average passing rate of the queue;

determining a traffic status of the intersection based on the plurality of traffic parameters, wherein the traffic status of the intersection includes a second traffic status, and the method further includes:

determining a plurality of dissipation times of a plurality of queues in the plurality of traffic-regulated sections;

determining whether one of the plurality of dissipation times is more than a first green light time of a first traffic light, wherein the first traffic light corresponds to a first traffic-regulated section which corresponds to the one of the plurality of dissipation times;

determining whether each of the plurality of queue lengths of the plurality of traffic-regulated sections is less than a threshold length in response to the determination that each of the plurality of dissipation time is less than or equal to a green light time of a corresponding traffic light; and determining the second traffic status in response to the determination that each of the plurality of queue lengths is less than the threshold length;

determine a target condition including a second target condition based on the second traffic status of the intersection; and generating a control parameter associated with a plurality of traffic lights based on a target function and the target condition, wherein a traffic light corresponds to a traffic-regulated section, and the control parameter is configured to alter the operation of the plurality of traffic lights to optimize traffic at the intersection to reach the target condition.

11. The method of claim 10, wherein the method further includes:

determining the target function based on the plurality of traffic parameters.

12. The method of claim 10, wherein the dissipation time is determined based on the queue length and the dissipation rate of the queue, and a dissipation time corresponds to a traffic-regulated section, the traffic status of the intersection further includes a first traffic status, and the method further includes:

determining the first traffic status in response to the determination that one of the plurality of dissipation times is more than the first green light time of the traffic light.

13. The method of claim 10, wherein the target condition further includes a first target condition, the traffic status of the intersection further includes a first traffic status, and the method further includes:

determining the first target condition based on the first traffic status, wherein the first target condition is to maximize an average number of vehicles that pass through the intersection.

14. The method of claim 10, wherein the second target condition is to minimize an average delay time of vehicles passing through at the intersection.

15. The method of claim 10, wherein the traffic status of the intersection further includes a third traffic status, and the method further includes:

determining the third traffic status in response to the determination that one of the plurality of queue lengths is longer than or equal to the threshold length.

16. The method of claim 15, further including:

determining a third target condition based on the third traffic status, wherein the third target condition is to minimize a highest ratio of the queue length to the threshold length among the ratios corresponding to the traffic-regulated sections at the intersection.

17. The method of claim 10, wherein the control parameter includes a cycle time of each traffic light, a ratio of green light time to cycle time of each traffic light, or a phase design of the plurality of traffic lights.

18. The method of claim 10, wherein the method further includes:

determining a constraint condition based on the traffic status, wherein the control parameter is determined based on the target function and the constraint condition.

19. A non-transitory computer readable medium comprising at least one set of instructions for generating a control parameter associated with a plurality of traffic lights for a plurality of traffic-regulated sections at an intersection, a traffic light corresponding to a traffic-regulated section, wherein when executed by at least one processor, the at least one set of instructions cause the at least one processor to effectuate a method comprising:

obtaining a plurality of traffic parameters for the plurality of traffic-regulated sections, wherein the plurality of traffic parameters comprise a queue length of each individual traffic-regulated section in the plurality of traffic-regulated sections, an aggregation rate of the queue, a dissipation rate of the queue, or an average passing rate of the queue;

determining a traffic status of the intersection based on the plurality of dissipation times of the plurality of queues, wherein the traffic status of the intersection includes a second traffic status, and the at least one set of instructions further cause the at least one processor to effectuate a method comprising:

determining a plurality of dissipation times of a plurality of queues in the plurality of traffic-regulated sections;

determining whether one of the plurality of dissipation times is more than a first green light time of a first traffic light, wherein the first traffic light corresponds to a first traffic-regulated section which corresponds to the one of the plurality of dissipation times;

determine whether each of the plurality of queue lengths of the plurality of traffic-regulated sections is less than a threshold length in response to the determination that each of the plurality of dissipation time is less than or equal to a green light time of a corresponding traffic light; and determine the second traffic status in response to the determination that each of the plurality of queue lengths is less than the threshold length;

determining a target condition including a second target condition based on the second traffic status of the intersection; and generating the control parameter associated with the plurality of traffic lights based on a target function and the target condition, wherein the control parameter is configured to alter the operation of the plurality of traffic lights to optimize traffic at the intersection to reach the target condition.

20. The non-transitory computer readable medium of claim 19, wherein the second target condition is to minimize an average delay time of vehicles passing through at the intersection.

* * * * *